US012560408B2

(12) United States Patent
Jiang et al.

(10) Patent No.: US 12,560,408 B2
(45) Date of Patent: Feb. 24, 2026

(54) RED DOT SIGHT CHARGING COVER, RECHARGEABLE RED DOT SIGHT AND RECHARGEABLE SIGHT ASSEMBLY

(71) Applicant: Shenzhen Obuy Technology Co., Ltd, Shenzhen (CN)

(72) Inventors: Weimin Jiang, Shenzhen (CN); Manchun Cai, Shenzhen (CN)

(73) Assignee: Shenzhen Obuy Technology Co., Ltd, Shenzhen (CN)

( * ) Notice: Subject to any disclaimer, the term of this patent is extended or adjusted under 35 U.S.C. 154(b) by 28 days.

(21) Appl. No.: 18/790,760

(22) Filed: Jul. 31, 2024

(65) Prior Publication Data

US 2025/0362110 A1 Nov. 27, 2025

(30) Foreign Application Priority Data

May 21, 2024 (CN) ..... 202410636857.6

(51) Int. Cl.
*F41G 1/30* (2006.01)

(52) U.S. Cl.
CPC ..... *F41G 1/30* (2013.01)

(58) Field of Classification Search
CPC ..... F41G 1/30
USPC ..... 42/113
See application file for complete search history.

(56) References Cited

U.S. PATENT DOCUMENTS

2012/0151816 A1* 6/2012 Kleck ..... F41G 1/30 42/111
2021/0207928 A1* 7/2021 Brewer ..... F41G 1/16
2021/0396490 A1* 12/2021 Pischke ..... F41G 1/30
2022/0034629 A1* 2/2022 Hamilton ..... F41G 1/30
2023/0384049 A1* 11/2023 York ..... F41A 19/01
2025/0044060 A1* 2/2025 Cohen ..... G02B 23/105

FOREIGN PATENT DOCUMENTS

WO WO-2021222842 A1 * 11/2021 ..... F41G 1/30

OTHER PUBLICATIONS

Product page for "OLIGHT Osight 3 MOA Rechargeable Dot Open Reflex Sight with Charging Cover, Tactical Parallax-Free Sights, Picatinny Mount Compatible—Green/Red Dot Options" on Amazon.com (Year: 2024).*

* cited by examiner

*Primary Examiner* — Samir Abdosh
(74) *Attorney, Agent, or Firm* — Ballard Spahr LLP

(57) ABSTRACT

A red dot sight charging cover, a rechargeable red dot sight, and a rechargeable sight assembly are provided. The red dot sight charging cover includes a housing and a charging cover circuit board, a charging cover battery, and a charging cover conductive assembly that are provided in the housing. A shape of the housing is adapted to a rechargeable red dot sight, and the housing detachably covers the rechargeable red dot sight. When the housing covers the rechargeable red dot sight, the charging cover conductive assembly is electrically connected to the rechargeable red dot sight. The charging cover circuit board is electrically connected to the charging cover battery and the charging cover conductive assembly, respectively, and the charging cover circuit board is configured to control the charging cover battery to supply power to the rechargeable red dot sight through the charging cover conductive assembly.

18 Claims, 16 Drawing Sheets

RED DOT SIGHT CHARGING COVER, RECHARGEABLE RED DOT SIGHT AND RECHARGEABLE SIGHT ASSEMBLY

CROSS-REFERENCE TO RELATED APPLICATIONS

This application claims priority of Chinese Patent Application No. 2024106368576, filed on May 21, 2024, entitled "RED DOT SIGHT CHARGING COVER, RECHARGEABLE RED DOT SIGHT AND RECHARGEABLE SIGHT ASSEMBLY", the entire content of which is incorporated herein in its entirety.

TECHNICAL FIELD

The present disclosure relates to the field of sights, and in particular to a red dot sight charging cover, a rechargeable red dot sight, and a rechargeable sight assembly.

BACKGROUND

A red dot sight is a non-magnifying optical sight with a bright aiming point, which is usually a red dot, so that it is called a red dot sight.

Since the light spot incident on the eye in a red dot mirror is always balanced with the red dot mirror, even if an eye of a user is not on a center axis of the red dot mirror, it can accurately aim through the red dot, which can improve a shooting accuracy when the user moves at high speed or the body of the user shakes. Therefore, it is widely applied to the head-up display device (HUD), and is applicable to both the conventional application environment and the harsh application environment.

A battery of the conventional red dot sight is mounted at the bottom of a main body thereof, and the battery needs to be replaced after being used for a period of time. When replacing the battery, the red dot sight needs to be disassembled first. Due to assembly tolerances, the red dot sight needs to be recalibrated after being disassembled and assembled each time, and recalibration is a tedious matter. Each time the battery is replaced, the sight needs to be calibrated once, which brings great inconvenience to use.

SUMMARY

Accordingly, a red dot sight charging cover, a rechargeable red dot sight, and a sight assembly are provided.

A red dot sight charging cover includes a housing and a charging cover circuit board, a charging cover battery, and a charging cover conductive assembly that are provided in the housing. A shape of the housing is adapted to a rechargeable red dot sight, and the housing detachably covers the rechargeable red dot sight. When the housing covers the rechargeable red dot sight, the charging cover conductive assembly is electrically connected to the rechargeable red dot sight. The charging cover circuit board is electrically connected to the charging cover battery and the charging cover conductive assembly, respectively, and the charging cover circuit board is configured to control the charging cover battery to supply power to the rechargeable red dot sight through the charging cover conductive assembly.

In one of the embodiments, the housing covers the rechargeable red dot sight from top to bottom.

In one of the embodiments, the housing is provided with an inner cavity, and the charging cover circuit board, the charging cover battery, and the charging cover conductive assembly are accommodated in the inner cavity.

In one of the embodiments, the red dot sight charging cover further includes a covering body detachably covered on the housing to close the housing from the top the housing, when the covering body is removed, the charging cover circuit board is completely exposed to remove the charging cover circuit board.

In one of the embodiments, the red dot sight charging cover further includes a sealing ring, the covering body is sealingly covered on the housing through the sealing ring.

In one of the embodiments, the red dot sight charging cover further includes a magnet provided in the housing and adjacent to the charging cover conductive assembly, the magnet is configured to magnetically attract the rechargeable red dot sight or a red dot sight negative conductive member of the rechargeable red dot sight, so that the charging cover conductive assembly is positioned and is electrically connected to the rechargeable red dot sight.

In one of the embodiments, the red dot sight charging cover further includes a control switch provided in the housing and exposed from the housing, the control switch is electrically connected to the charging cover circuit board and is configured to control the charging cover battery to be electrically connected to or disconnected form the charging cover conductive assembly.

In one of the embodiments, the control switch includes a button, a button spring, and a switch, the button is at least partially exposed from the housing, and the button spring elastically abuts between the button and the switch, and the switch is electrically connected to the charging cover circuit board.

In one of the embodiments, the red dot sight charging cover further includes a charging terminal provided in the housing and exposed from the housing, the charging terminal is electrically connected to the charging cover circuit board and is configured to be connected to an external power source to charge the charging cover battery.

In one of the embodiments, the red dot sight charging cover further includes a display screen provided in the housing and electrically connected to the charging cover circuit board.

In one of the embodiments, one of the housing and the rechargeable red dot sight is provided with a convex portion or a groove, the other one of the housing and the rechargeable red dot sight is provided with a groove or convex portion, when the housing covers the rechargeable red dot sight, the housing is engaged with the rechargeable red dot sight through the corresponding convex portion and the groove.

In one of the embodiments, the charging cover circuit board is configured to control the charging cover battery to charge a red dot sight battery of a chargeable red dot sight through the charging cover conductive assembly.

A rechargeable red dot sight is further provided. The rechargeable red dot sight includes a red dot sight body and a conductive connecting member, the conductive connecting member is provided on the red dot sight body, and the conductive connecting member is electrically connected to a red dot sight charging cover or a charging cover conductive assembly of a red dot sight charging cover.

In one of the embodiments, the rechargeable red dot sight further includes a light sensing and adjusting member provided on the red dot sight body, the light sensing and adjusting member is configured to sense light intensity of an external environment and adjust brightness of a light source red dot of the red dot sight body according to the light intensity.

In one of the embodiments, the rechargeable red dot sight further includes a red dot sight battery provided in the red dot sight body, the charging cover conductive assembly electrically abuts against the conductive connecting member and is electrically connected to the red dot sight battery through the conductive connecting member.

In one of the embodiments, the conductive connecting member includes a red dot sight positive conductive member, an insulating member, a red dot sight negative conductive member, two conductive springs, and a red dot sight circuit board, the red dot sight positive conductive member is spaced apart from the red dot sight negative conductive member through the insulating member, the red dot sight positive conductive member is electrically connected to the red dot sight circuit board through one of the conductive springs, the red dot sight negative conductive member is electrically connected to the red dot sight circuit board through the other conductive spring, the red dot sight circuit board is electrically connected to the red dot sight battery, and the charging cover conductive assembly electrically abuts against the red dot sight positive conductive member and the red dot sight negative conductive member, respectively.

In one of the embodiments, the red dot sight positive conductive member and the red dot sight negative conductive member have contact surfaces with the same height, and the charging cover conductive assembly electrically abuts against the red dot sight positive conductive member and the red dot sight negative conductive member at the contact surface, respectively.

A rechargeable sight assembly is further provided. The rechargeable sight assembly includes a rechargeable red dot sight and the above-mentioned red dot sight charging cover, the rechargeable red dot sight includes a red dot sight body and a conductive connecting member, the conductive connecting member is provided on the red dot sight body, the conductive connecting member is electrically connected to a red dot sight charging cover or a charging cover conductive assembly of a red dot sight charging cover, the housing of the red dot sight charging cover detachably covers the rechargeable red dot sight, and the charging cover conductive assembly of the red dot sight charging cover is electrically connected to the rechargeable red dot sight or a red dot sight battery of a rechargeable red dot sight.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

Figure 1:
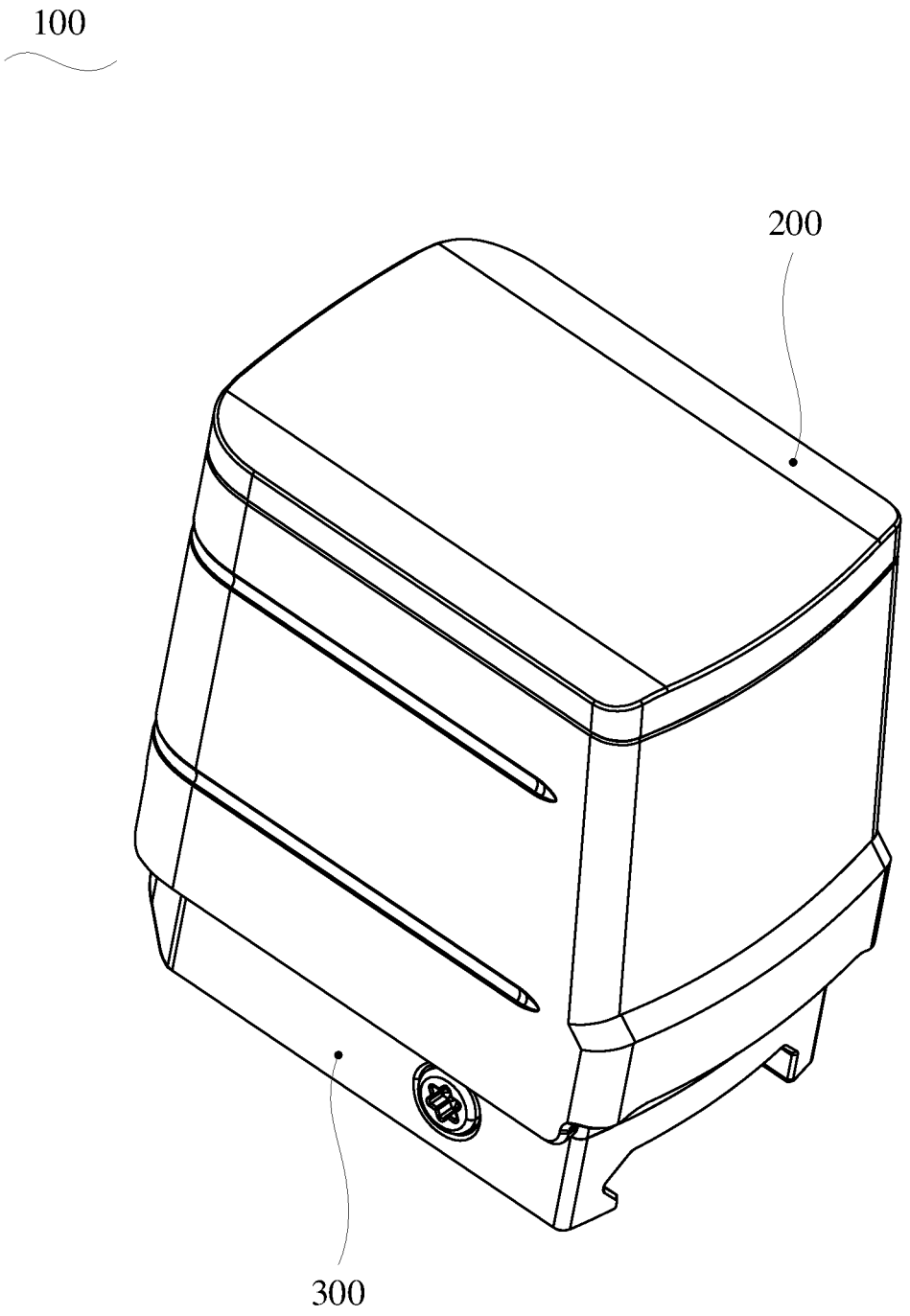
FIG. 1 is a perspective view of a rechargeable sight assembly according to an embodiment of the present disclosure.

Reference numerals: rechargeable sight assembly 110, red dot sight charging cover 200, rechargeable red dot sight 300, charging device 400, covering body 210, sealing ring 220, charging cover circuit board 230, screw 231, charging cover battery 240, protective case 241, magnet 250, charging cover conductive assembly 260, housing 270, inner cavity 270, charging terminal 280, control switch 290, button 291, button spring 292, switch 293, red dot sight body 310, light sensing and adjusting member 311, light source output end 312, mounting groove 313, red dot sight positive conductive member 320, insulating member 330, red dot sight negative conductive member 340, conductive spring 350, red dot sight circuit board 360, red dot sight battery 370, lens 380, conductive connecting member 390.

DETAILED DESCRIPTION OF THE EMBODIMENTS

In order to make the above objects, features and advantages of the present disclosure clear and easier to understand, the specific embodiments of the present disclosure are described in detail below in combination with the accompanying drawings. Many specific details are set forth in the following description to facilitate a full understanding of the present disclosure. However, the present disclosure can be implemented in many ways different from those described herein, and those skilled in the art can make similar improvements without departing from the connotation of the present disclosure. Therefore, the present disclosure is not limited by the specific embodiments disclosed below.

It should be noted that when an element is referred to as being "fixed to" or "disposed on" another element, it can be directly on the other element or an intervening element may also be present. When an element is referred to as being "connected" to another element, it can be directly connected to the other element or intervening elements may also be present. The terms "vertical", "horizontal", "upper", "lower", "left", "right" and similar expressions used herein are for the purpose of illustration only and do not represent the only embodiment.

In addition, the terms "first" and "second" are only used for descriptive purposes and cannot be understood as indicating or implying relative importance or implicitly indicating the number of indicated technical features. Thus, the features defined with "first" and "second" may explicitly or implicitly include at least one of the features. In the description of the present disclosure, "a plurality of" means at least two, such as two, three, etc., unless otherwise expressly and specifically defined.

In the present disclosure, unless otherwise expressly specified and limited, the first feature "above" or "below" the second feature may be in direct contact with the first and second features, or the first and second features may be in indirect contact through an intermediate medium. Moreover, the first feature is "above" the second feature, but the first feature is directly above or diagonally above the second feature, or it only means that the horizontal height of the first feature is higher than the second feature. The first feature is "below" of the second feature, which can mean that the first feature is directly below or obliquely below the second feature, or simply that the horizontal height of the first feature is less than that of the second feature.

Unless otherwise defined, all technical and scientific terms used herein have the same meaning as commonly understood by one of ordinary skill in the art to which this application belongs. The terms used herein in the description of the present disclosure are for the purpose of describing specific embodiments only, and are not intended to limit the present disclosure. As used herein, the term "and/or" includes any and all combinations of one or more of the associated listed items.

The present disclosure provides a red dot sight charging cover, a rechargeable red dot sight, and a rechargeable sight assembly, which include some or all of the technical features of the following embodiments. That is, the red dot sight charging cover, the rechargeable red dot sight, and the rechargeable sight assembly include some or all of the following structures. In one embodiment of the present disclosure, a red dot sight charging cover includes a housing and a charging cover circuit board, a charging cover battery, and a charging cover conductive assembly that are provided in the housing. A shape of the housing is adapted to the rechargeable red dot sight, so that the housing detachably covers the rechargeable red dot sight. When the housing covers the rechargeable red dot sight, the charging cover conductive assembly is electrically connected to the rechargeable red dot sight. The charging cover circuit board is electrically connected to the charging cover battery and the charging cover conductive assembly, respectively. The charging cover circuit board is configured to control the charging cover battery to supply power to the rechargeable red dot sight through the charging cover conductive assembly. According to the above-mentioned red dot sight charging cover, the charging cover circuit board, the charging cover battery, and the charging cover conductive assembly are in cooperation with the housing. On the one hand, when in use, only the rechargeable red dot sight is covered by the red dot sight charging cover, the rechargeable red dot sight can be powered or charged while the dustproof protection is provided for the rechargeable red dot sight, which has the advantages of simplicity and convenience in use. On the other hand, the rechargeable red dot sight does not need to be reassembled and disassembled due to battery replacement or battery charging, so that the rechargeable red dot sight does not need to be recalibrated due to battery replacement or battery charging, which greatly improves the convenience of using the rechargeable red dot sight. The red dot sight charging cover, the rechargeable red dot sight and the rechargeable sight assembly will be described in detail below with reference to FIGS. 1 to 16.

Figure 2:
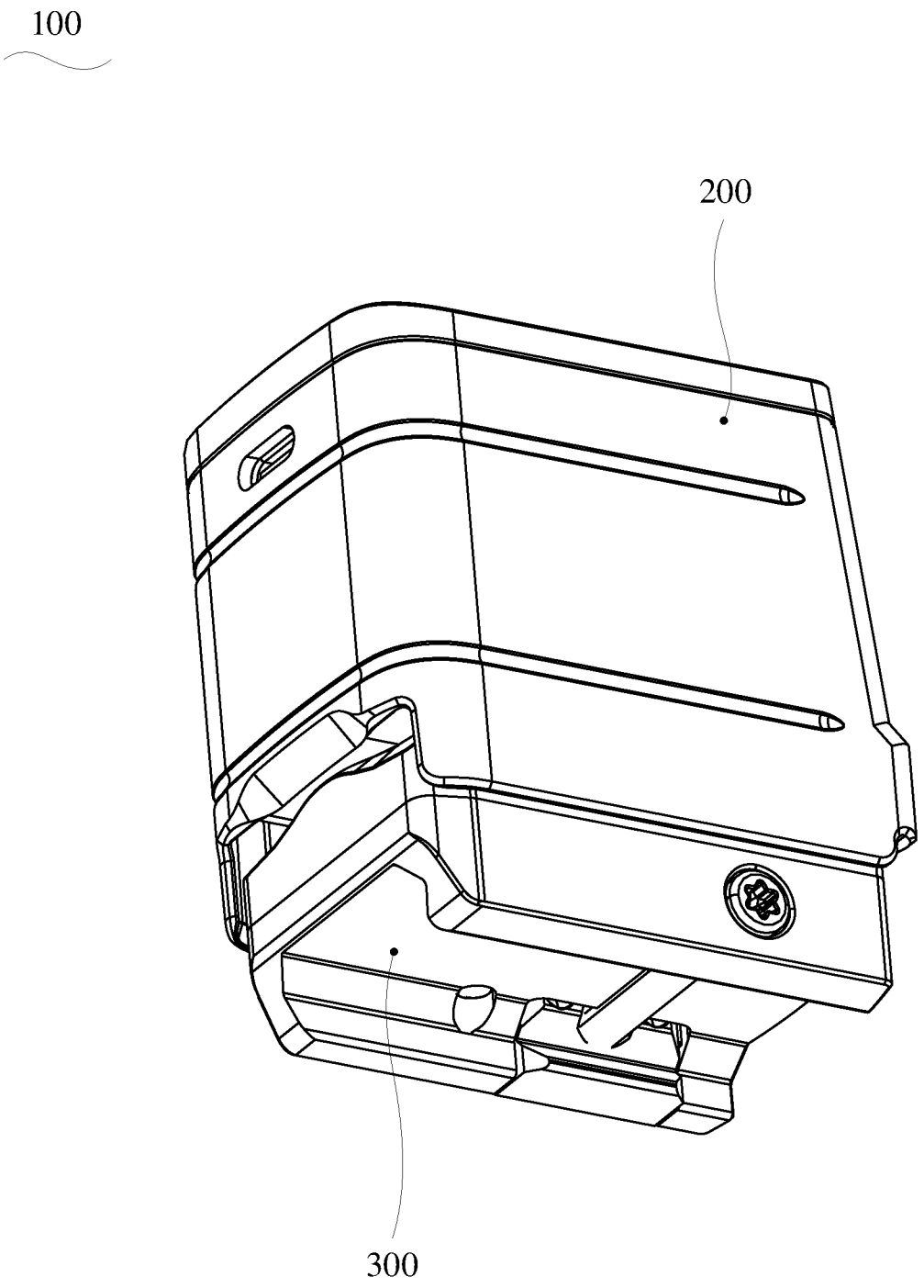
FIG. 2 is a similar to FIG. 1, but viewed from another aspect.

In one embodiment, a rechargeable sight assembly 100 as shown in FIGS. 1 and 2, which includes a red dot sight charging cover 200 and a rechargeable red dot 300. It should be understood that the red dot sight charging cover 200 may be a red dot sight charging cover 200 in any of the embodiments provided herein, and the rechargeable red dot sight 300 may be a rechargeable red dot sight 300 in any of the embodiments provided herein. The red dot sight charging cover 200 detachably covers the rechargeable red dot sight 300. With such a structural design, it is only necessary to cover the rechargeable red dot sight 300 with the red dot sight charging cover 200 during use, which is convenient for use. In an embodiment, the red dot sight charging cover 200 may cover a top surface and side surfaces of the rechargeable red dot sight 300.

In addition, in a state that the red dot sight charging cover 200 covers the rechargeable red dot sight 300, the red dot sight charging cover 200 supplies power to the rechargeable red dot sight 300, which includes using the red dot sight charging cover 200 as a power supply of the rechargeable red dot sight 300, that is, the battery of the red dot sight charging cover 200 is used as a battery of the rechargeable red dot sight 300. In this way, the rechargeable red dot sight 300 may not be provided with a battery, and therefore, the rechargeable red dot sight 300 may also be referred to as a red dot sight or a red dot sight without a battery. Alternatively, the red dot sight charging cover 200 is used to charge the rechargeable red dot sight 300, that is, the battery of the red dot sight charging cover 200 is used to charge the battery of the rechargeable red dot sight 300. In other words, the red dot sight charging cover 200 indirectly charges the rechargeable red dot sight 300. With such structure design, on the one hand, the red dot sight charging cover 200 can protect the rechargeable red dot sight 300 and serves as daily protection, and on the other hand, the red dot sight charging cover 200 can supply power or charge the rechargeable red dot sight 300 while protecting the rechargeable red dot sighting telescope 300 against dust, which has the advantage of simplicity and convenience in use.

In one embodiment, a rechargeable sight assembly 100 includes a rechargeable red dot sight 300 in any embodiment and a red dot sight charging cover 200 in any embodiment. The red dot sight charging cover 200 includes a housing 270 detachably covering the rechargeable red dot sight 300. Specifically, the housing 270 is detachably sleeved on the rechargeable red dot sight 300. The red dot sight charging cover 200 includes a charging cover conductive componen 260. The rechargeable red dot sight 300 includes a red dot sight battery 370. The charging cover conductive componen 260 is electrically connected to the rechargeable red dot sight 300 or the red dot sight battery 370. It should be understood that, in each embodiment, since the rechargeable sight assembly 100 adopts the rechargeable red dot sight 300 in any embodiment and the red dot sight charging cover 200 in any embodiment, the rechargeable sight assembly 100 has the beneficial technical effects of the rechargeable red dot sight 300 and the red dot sight charging cover 200, which are not described in detail herein.

Figure 3:
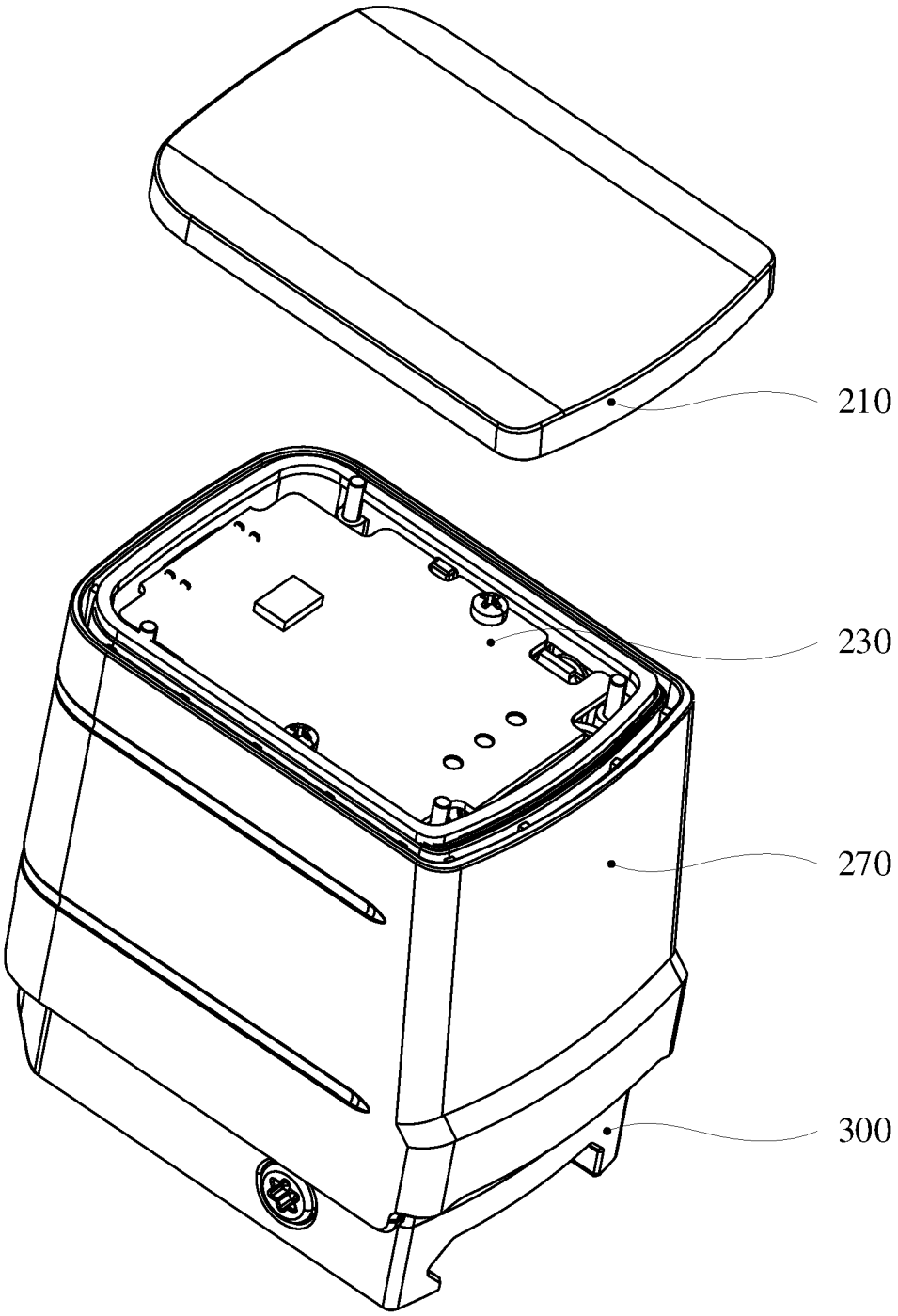
FIG. 3 is an exploded view of the rechargeable sight assembly shown in FIG. 1.
Figure 4:
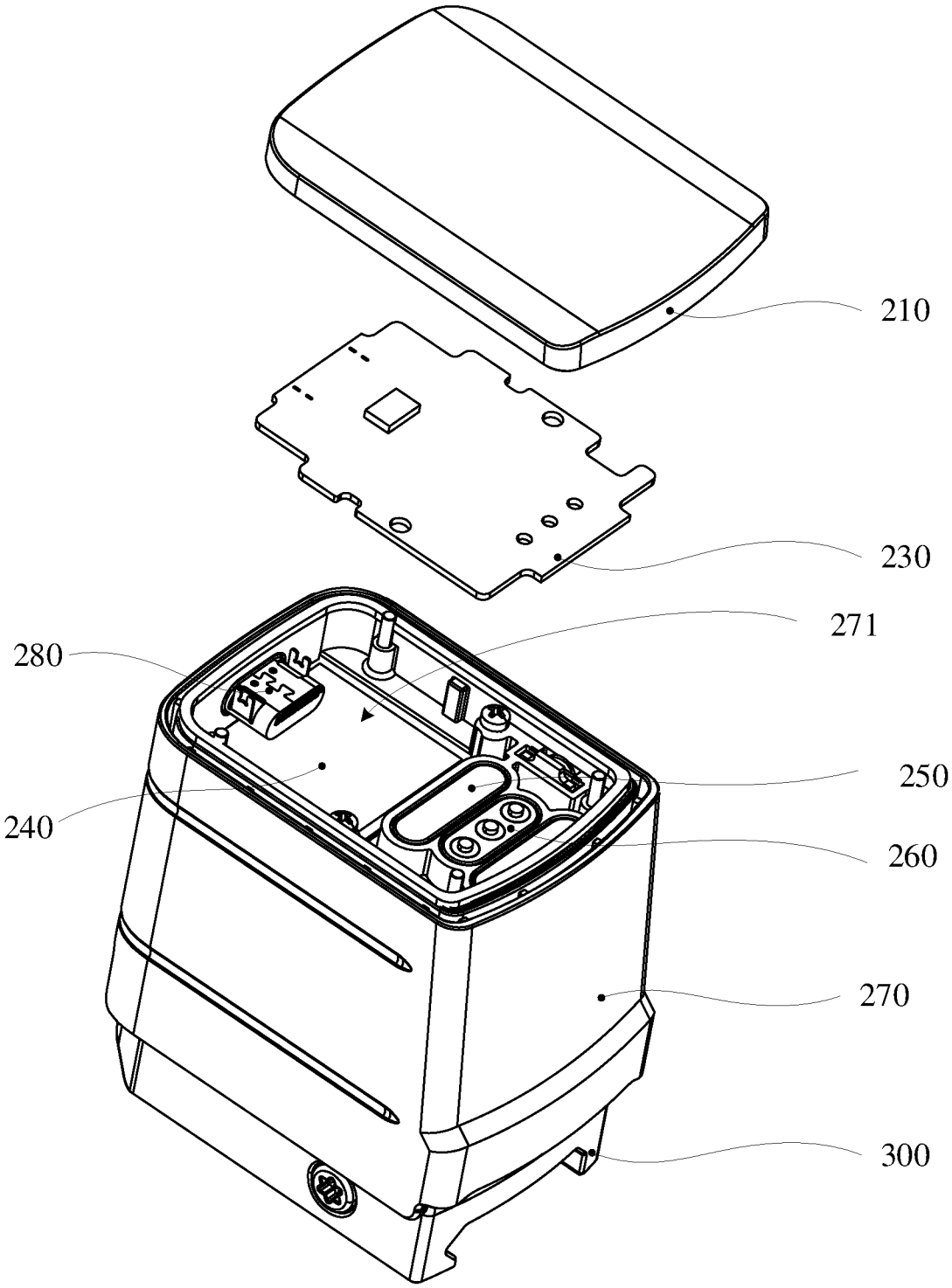
FIG. 4 is a further exploded view of the rechargeable sight assembly of FIG. 3.

In one embodiment, as shown in FIGS. 3 and 4, the red dot sight charging cover 200 covers the rechargeable red dot sight 300. In this embodiment, the red dot sight charging cover 200 includes a housing 270 and a charging cover circuit board 230, a charging cover battery 240, and a charging cover conductive assembly 260 that are provided in the housing 270. The charging cover circuit board 230 is electrically connected to the charging cover battery 240 and the charging cover conductive assembly 260, respectively. The charging cover circuit board 230 is configured to control the charging cover battery 240 to supply power to the rechargeable red dot sight 300 through the charging cover conductive assembly 260. As described above, such configuration is applicable to the red dot sight with battery or without battery. In one embodiment, referring to FIG. 16, the charging cover circuit board 230 is configured to control the charging cover battery 240 to charge a red dot sight battery 370 of the chargeable red dot sight 300 through the charging cover conductive assembly 260, and such configuration is applicable to the red dot sight with a battery, and is further especially applicable to the lightweight chargeable red dot sight 300. The red dot sight battery 370 can be always electrically connected to the red dot sight charging cover 200, so that the red dot sight battery 370 can always have power. Therefore, a small-sized battery can be adopted, so that the volume and weight required by the red dot sight battery 370 of the chargeable red dot sight 300 is reduced, and the weight of the chargeable red dot sight 300 is further reduced. It is known to those skilled in the art that, for some special equipment, the weight of each gram is very important, so shat the red dot sight charging cover 200 is not only important for calibration, but also reduces the weight of the chargeable red dot sight 300 when the chargeable red dot sight 300 is used, that is, the red dot sight charging cover 200 is removed.

Figure 5:
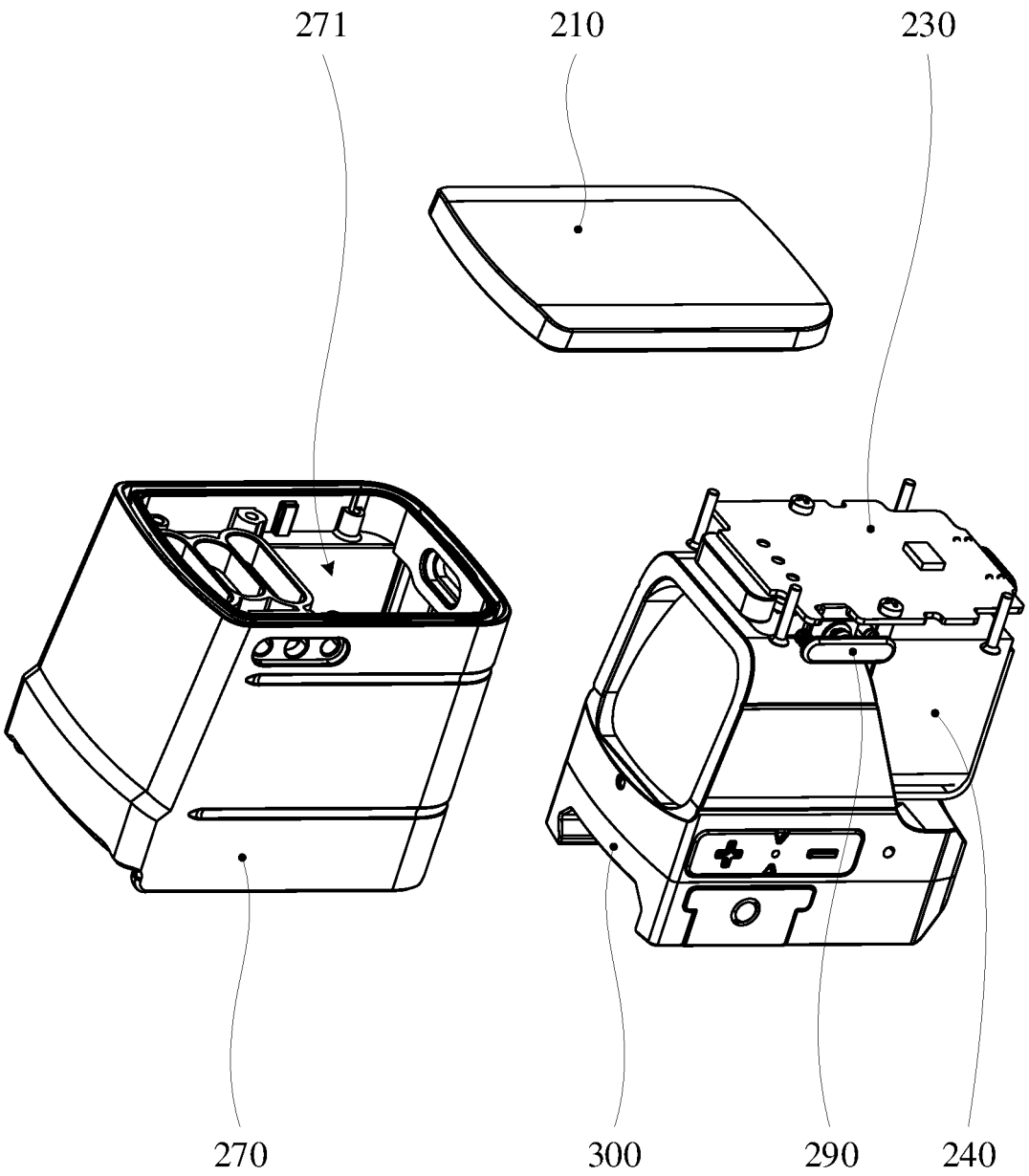
FIG. 5 is another exploded view of the rechargeable sight assembly shown in FIG. 3.

In conjunction with FIG. 5, the shape of the housing 270 is adapted to the rechargeable red dot sight 300, so that the housing 270 detachably covers the rechargeable red dot sight 300. In a state that the housing 270 covers the rechargeable red dot sight 300, the charging cover conductive assembly 260 is electrically connected to the rechargeable red dot sight 300. In one embodiment, the housing 270 is provided with a convex portion or a groove. When the housing 270 covers the rechargeable red dot sight 300, the housing 270 is engaged with a groove of the rechargeable red dot sight 300 through the convex portion, or the housing 270 is engaged with a convex portion of the rechargeable red dot sight 300 through the groove. That is, the convex portion of the housing 270 is engaged with the groove of the rechargeable red dot sight 300, or the groove of the housing 270 is engaged with the convex portion of the rechargeable red dot sight 300, so that the red dot sight charging cover 200 firmly covers the rechargeable red dot sight 300. Further, in one embodiment, the red dot sight charging cover 200 includes a buckle on the convex portion of the housing 270. The buckle is engaged in the groove of the rechargeable red dot sight 300 in an interference fit manner, and can be disengaged from the groove of the rechargeable red dot sight 300. With such a structural design, on the one hand, it is beneficial for tightly covering the charging cover 200 outside the rechargeable red dot sight 300, so as to ensure that the relative position between the red dot sight charging cover 200 and the rechargeable red dot sight 300 can be kept unchanged in the outdoor violent movement state. On the other hand, it is beneficial to ensure the charging cover conductive assembly 260 is electrically connected to the rechargeable red dot sight 300.

In this embodiment, the housing 270 covers the rechargeable red dot sight 300 from top to bottom. In other embodiments, the housing 270 may covers the rechargeable red dot sight 300 from left to right or from front to rear. Such a structural design facilitates the separate removal or mounting of the red dot sight charging cover 200 while keeping the position of the rechargeable red dot sight 300 unchanged. Therefore, there is no need to re-calibrate a device mounted with the rechargeable red dot sight 300 due to replacing or charging the battery.

Further, in one embodiment, as shown in FIGS. 3 and 4. The red dot sight charging cover 200 further includes a covering body 210, which is detachably covered on the housing 270 to close the housing 270 from the top of the housing 270. In conjunction with FIG. 5, when the covering body 210 is removed, the charging cover circuit board 230 is completely exposed to remove the charging cover circuit board 230 and mount the charging cover circuit board 230 again. Further, in one embodiment, in conjunction with FIGS. 8 and 9. The red dot sight charging cover 200 further includes a sealing ring 220. The covering body 210 is sealingly covered on the housing 270 through the sealing ring 220. Such a structural design facilitates the repair or maintenance of the charging cover circuit board 230, while the sealing ring 220 facilitates the enhancement of the waterproof performance, which is suitable for long-term outdoor use to protect the rechargeable red dot sight 300.

In one embodiment, the red dot sight charging cover 200 further includes a display screen provided in the housing 270 and electrically connected to the charging cover circuit board 230. In the embodiment of the red dot sight charging cover 200 including the covering body 210, the display screen may be provided in or on the covering body 210. Alternatively, in other embodiments, the display screen may be used instead of the covering body 210. In this embodiment, the structure corresponding to the mark 210 shown in FIGS. 3 and 4 may be used as the display screen, or it may be understood that the display screen is used as the covering body 210. In such a design, some information can be provided through the display screen, including, but not limited to, the remaining power of the red dot sight charging cover 200, the remaining available time of the red dot sight charging cover 200, the available power of the rechargeable red dot sight 300, and the like.

In one embodiment, as shown in FIGS. 4 and 5, the housing 270 is provided with an inner cavity 271. The charging cover circuit board 230, the charging cover battery 240, and the charging cover conductive assembly 260 are accommodated in the inner cavity 271. For embodiments having other structural members in addition to the charging cover circuit board 230, the charging cover battery 240, and the charging cover conductive assembly 260, exemplarily, in conjunction with FIGS. 6 and 7, these other structural members include, but are not limited to, a magnet 250, a charging terminal 280, a control switch 290, etc, which may also be partially or completely accommodated in the inner cavity 271. With such a structural design, when the housing 270 covers the rechargeable red dot sight 300, the housing 270 cooperates with the rechargeable red dot sight 300 to close the inner cavity 271, so that the charging cover circuit board 230, the charging cover battery 240, the charging cover conductive assembly 260, and other structural members can be properly protected, which is particularly suitable for providing dust-proof protection of the rechargeable red dot sight 300 outdoors for a long time.

Figure 6:
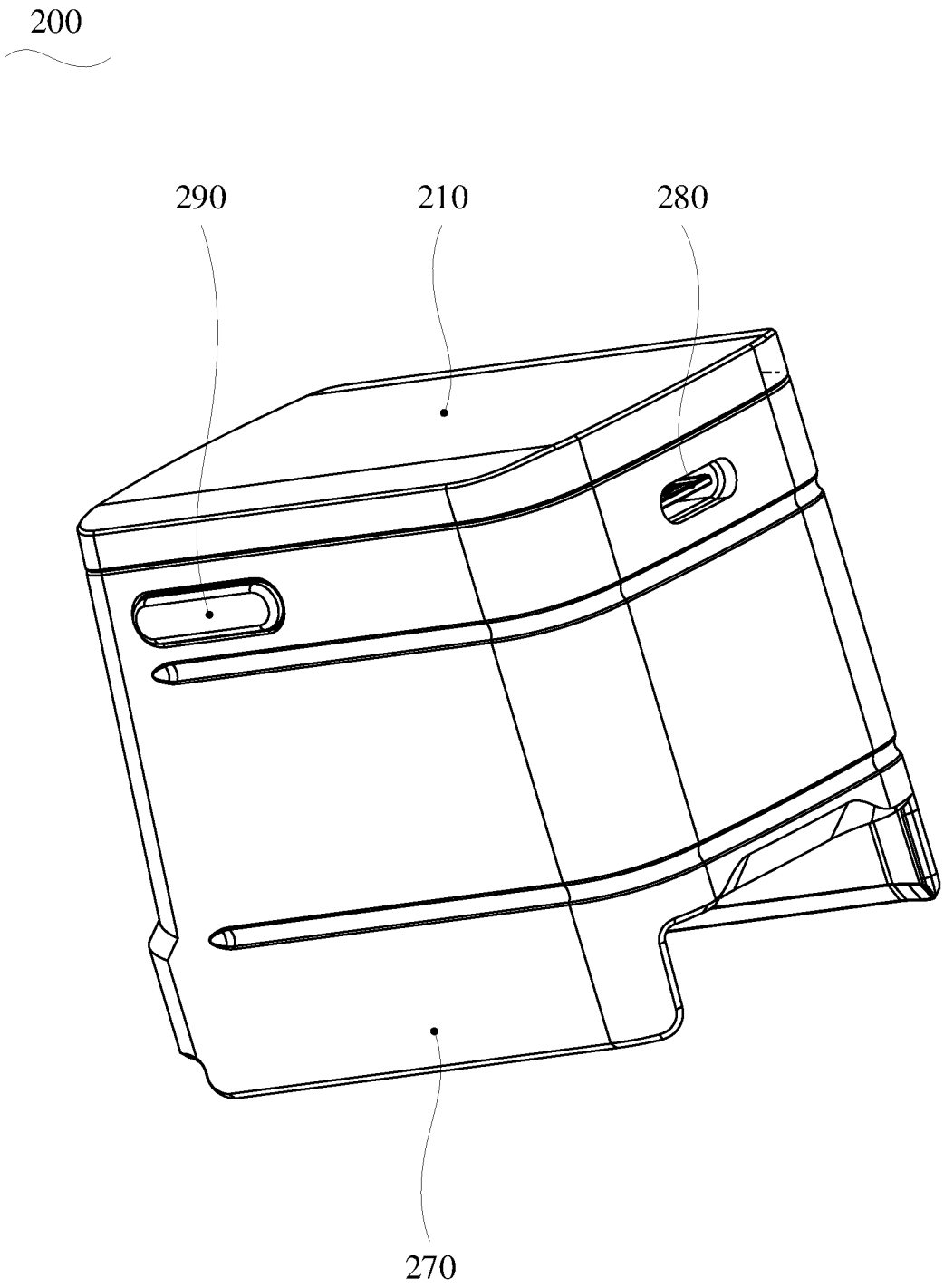
FIG. 6 is a perspective view of a rechargeable red dot sight charging cover of the rechargeable sight assembly shown in FIG. 1.

In one embodiment, as shown in FIGS. 5 and 6, the red dot sight charging cover 200 further includes a control switch 290 provided in the housing 270 and exposed from the housing 270. The control switch 290 is electrically connected to the charging cover circuit board 230, and is configured to control the charging cover battery 240 to be electrically connected to or disconnected form the charging cover conductive assembly 260. In conjunction with FIGS.

8 and 9, in one embodiment, the control switch 290 includes a button 291, a button spring 292, and a switch 293. The button 291 is at least partially exposed from the housing 270, and the button spring 292 elastically abuts between the button 291 and the switch 293. The switch 293 is electrically connected to the charging cover circuit board 230. Such a structural design facilitates simple and convenient control of whether the red dot sight charging cover 200 supplies power to the charging red dot sight 300. In the embodiment having the display screen, it is conducive to simple control of the display screen to be turned on or off.

Figure 7:
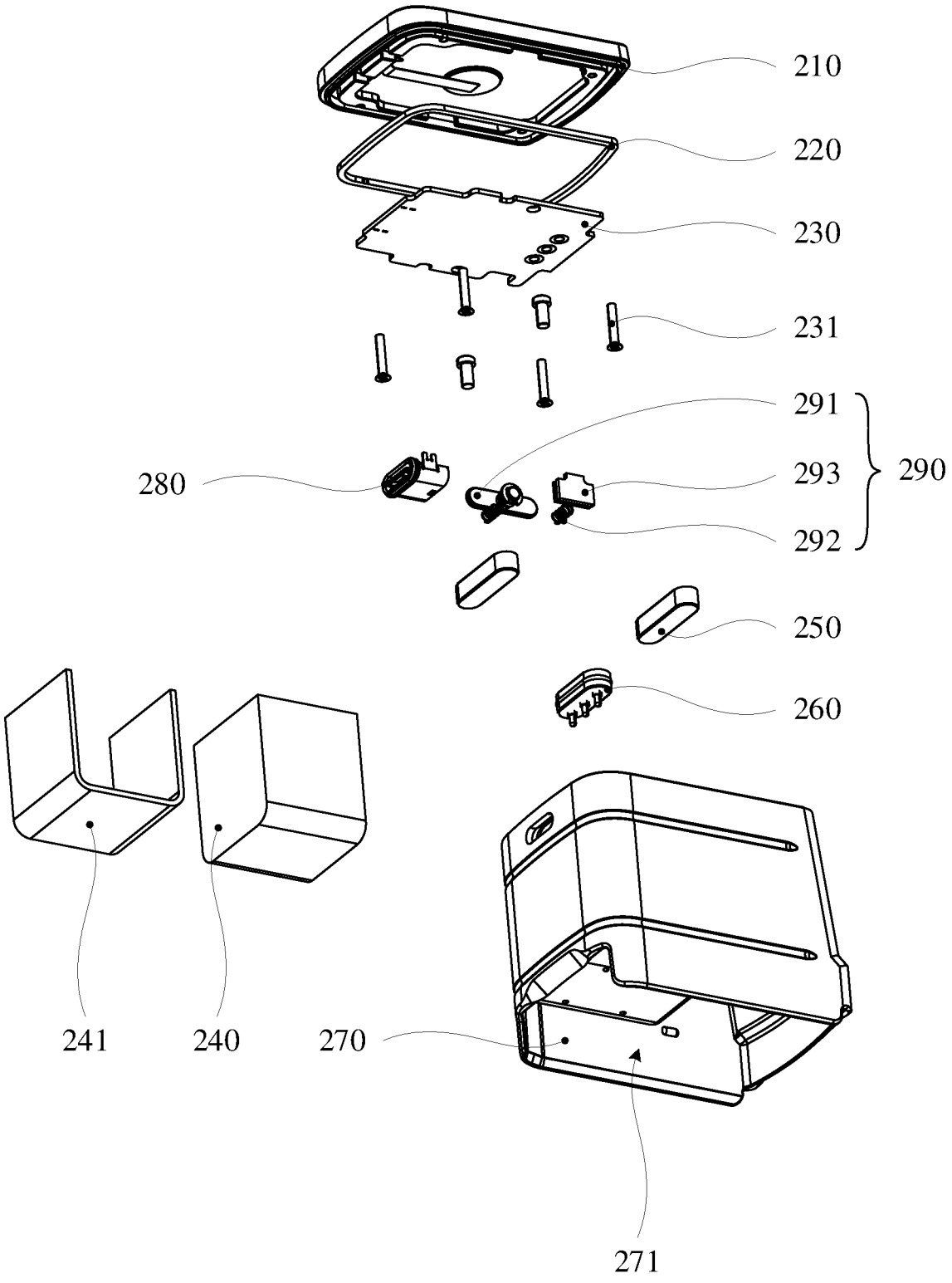
FIG. 7 is an exploded view of the rechargeable red dot sight charging cover shown in FIG. 6.
Figure 8:
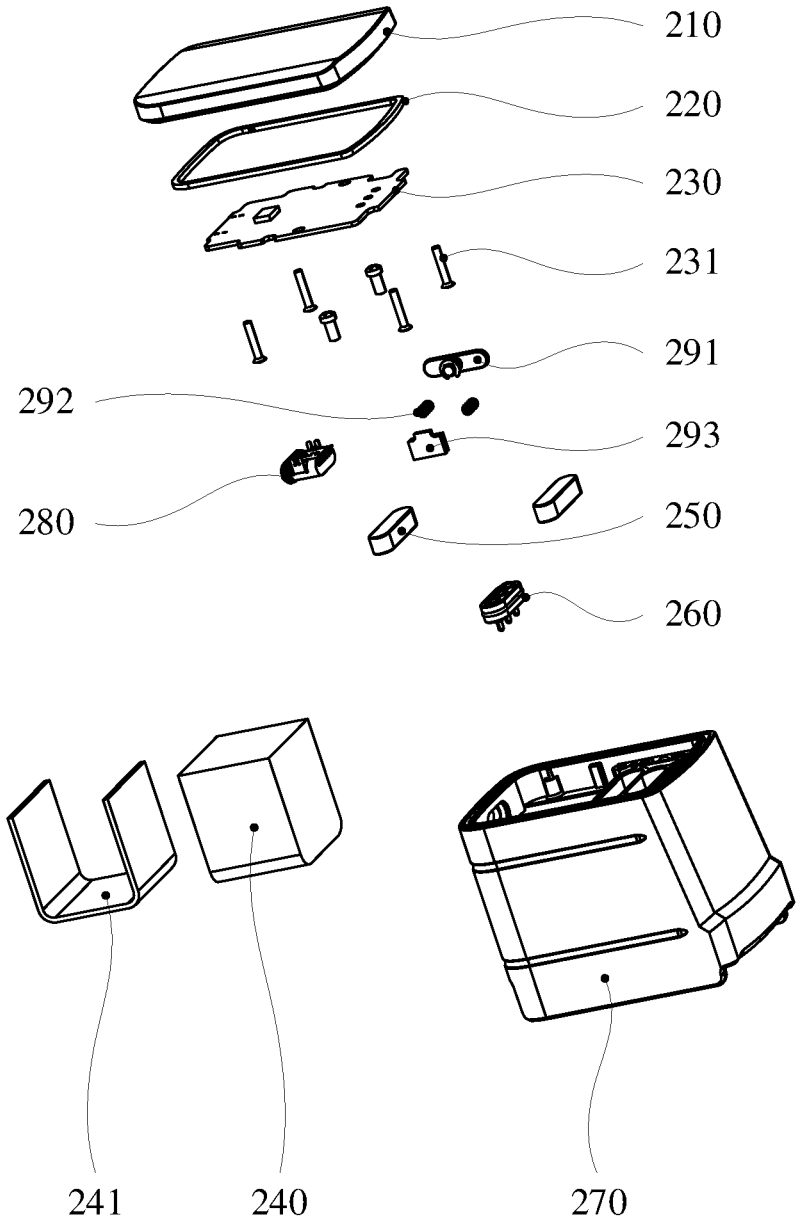
FIG. 8 is similar to FIG. 7, but viewed from another aspect.

Considering that the red dot sight charging cover 200 is used as a protective cover for the rechargeable red dot sight 300 outdoors for a long time. Further, in one embodiment, as shown in FIGS. 7 and 8, the red dot sight charging cover 200 further includes a protective case 241, and the protective case 241 is at least partially enclosed outside the charging cover battery 240 to protect the charging cover battery 240. It should be understood that, in each embodiment, the charging cover battery 240 and the red dot sight battery 370 are essentially batteries, which may be the same or different in size and shape. For convenience of description, different names are adopted to distinguish them. In conjunction with FIGS. 9 and 10, the charging cover circuit board 230 and the covering body 210 are detachably mounted to the housing 270 by screws 231, so as to facilitate disassembly and maintenance. Such a structural design facilitates further protection of the charging cover battery 240 during long-term use.

Figure 9:
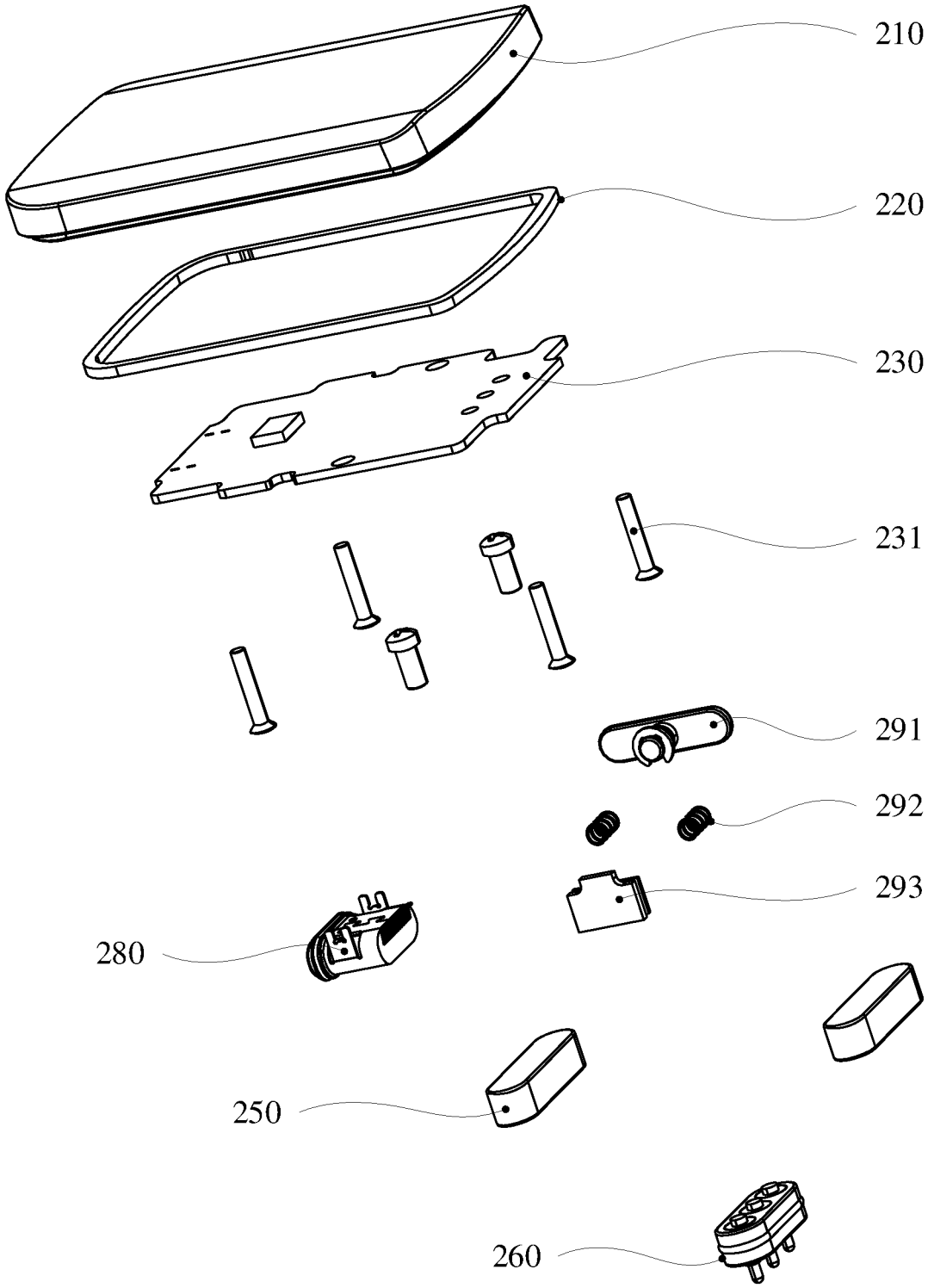
FIG. 9 is an enlarged view of a partial structure of the rechargeable red dot sight charging cover shown in FIG. 8.
Figure 10:
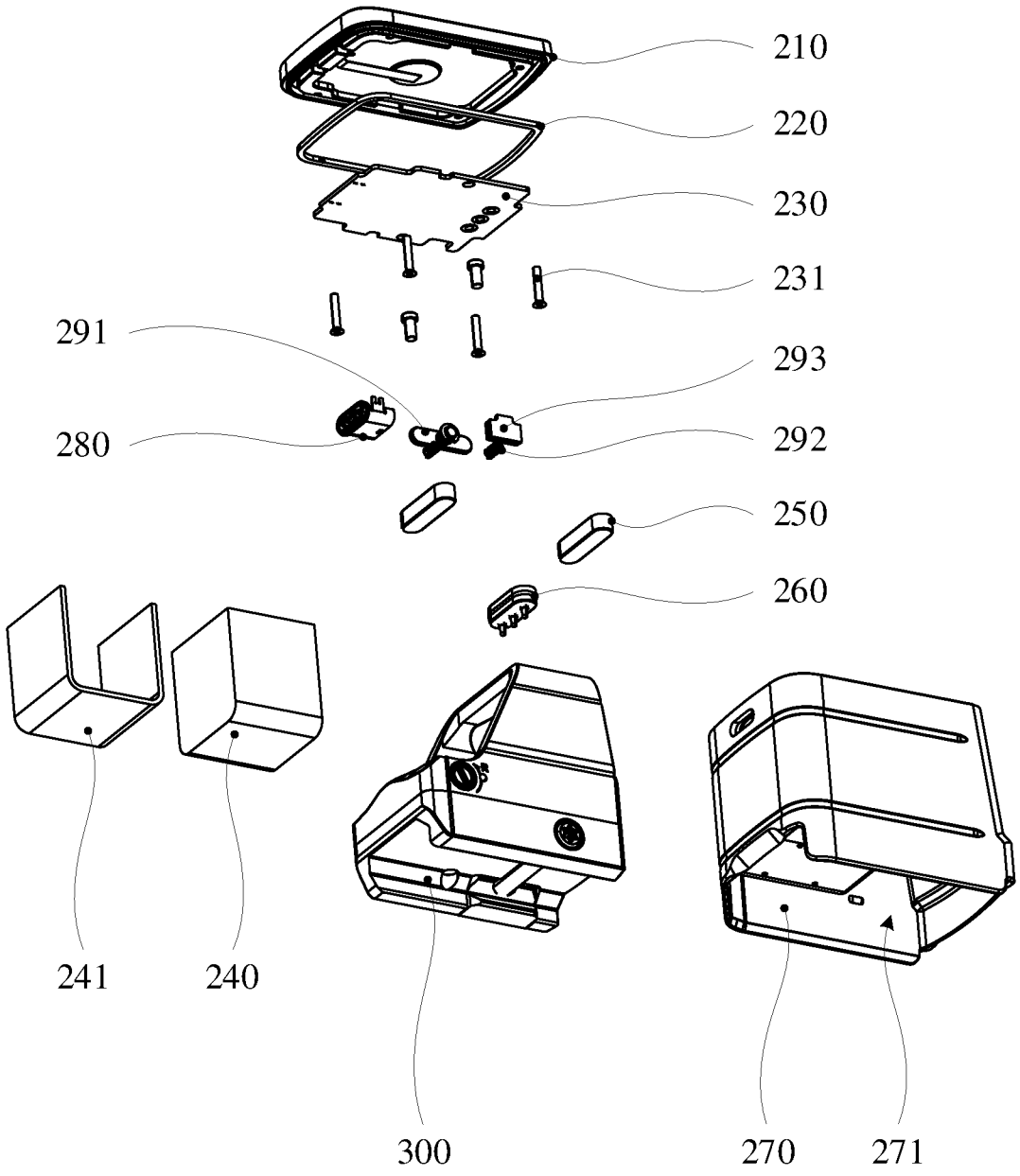
FIG. 10 is an exploded view of the rechargeable sight assembly shown in FIG. 2.

Further, in one embodiment, as shown in FIGS. 9 and 10. The red dot sight charging cover 200 further includes a magnet 250. In conjunction with FIG. 4, the magnet 250 is provided in the housing 270 and is adjacent to the charging cover conductive assembly 260. The magnet 250 is configured to magnetically attract the rechargeable red dot sight 300 or a red dot sight negative conductive member 340 thereof, so that the charging cover conductive assembly 260 is positioned and is electrically connected to the rechargeable red dot sight 300. Further, in one embodiment, a pair of magnets 250 are provided, and the charging cover conductive assembly 260 is located between the pair of magnets 250. Such a design facilitates accurate positioning of the charging cover conductive assembly 260 to ensure the power supply or charging effect of the red dot sight charging cover 200 on the rechargeable red dot sight 300.

Figure 11:
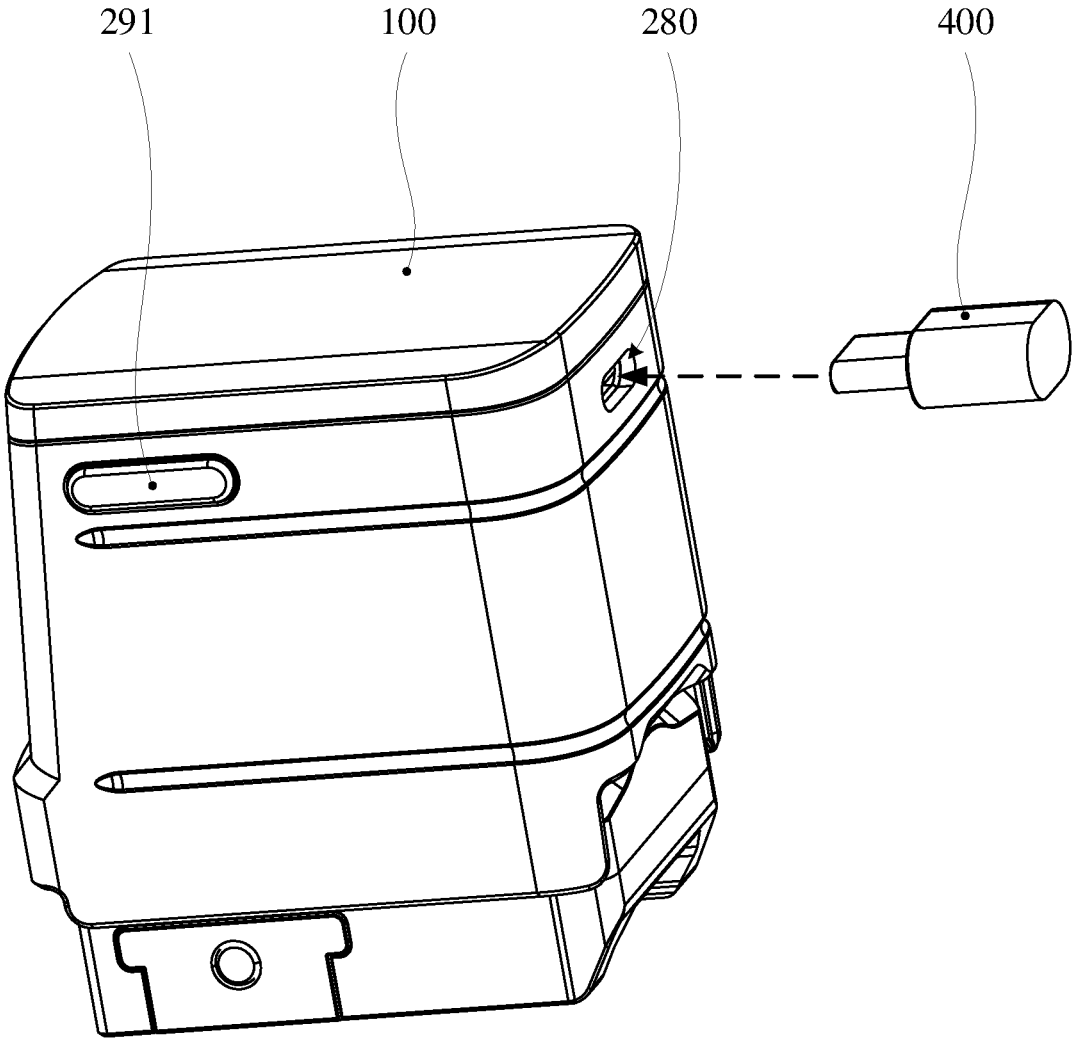
FIG. 11 is a schematic view illustrating a charging device mounted to the rechargeable sight assembly shown in FIG. 2.
Figure 12:
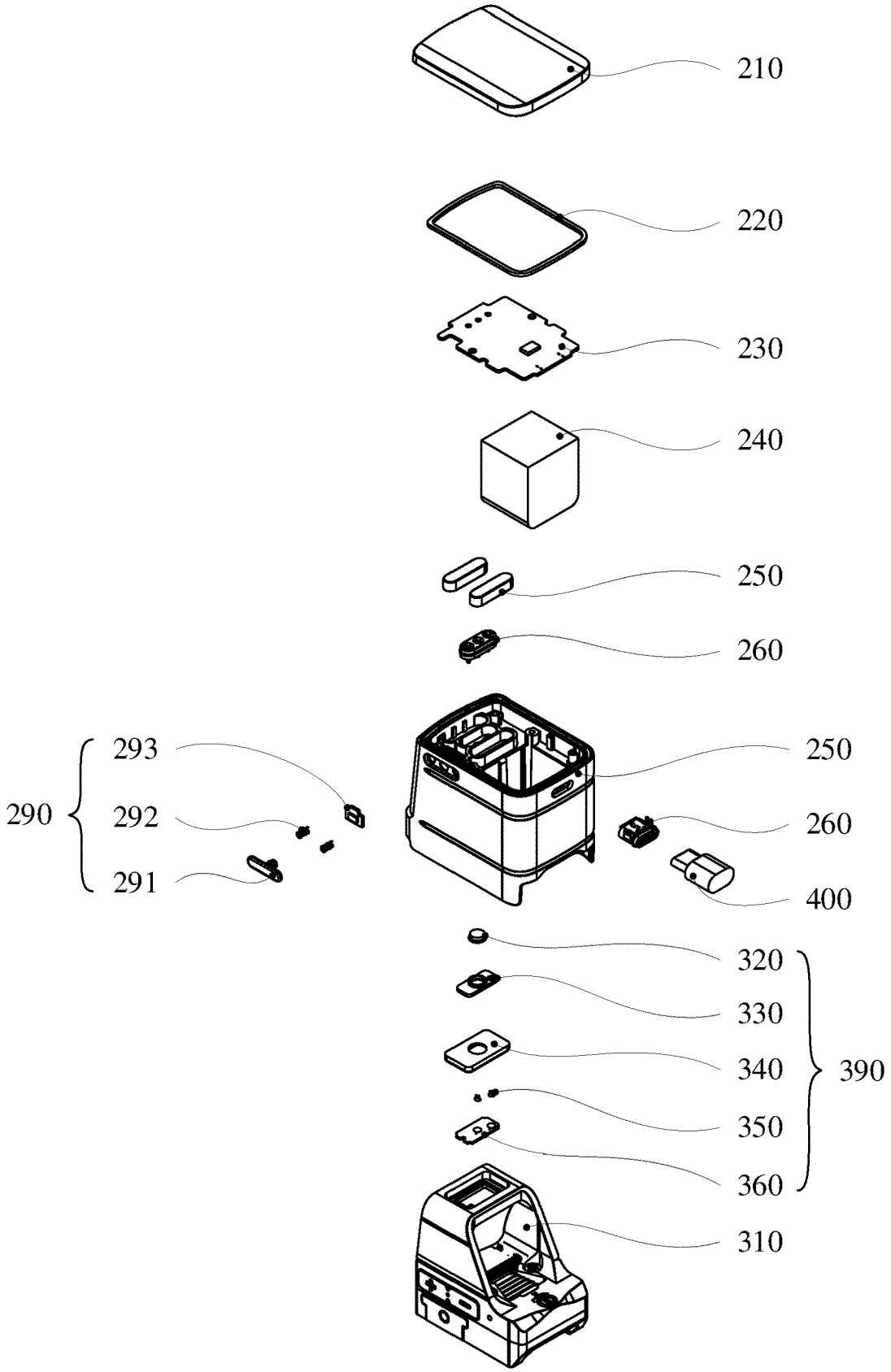
FIG. 12 is an exploded view of the embodiment shown in FIG. 11.

In one embodiment, as shown in FIGS. 6 and 7, the red dot sight charging cover 200 further includes a charging terminal 280 provided in the housing 270 and exposed from the housing 270. The charging terminal 280 is electrically connected to the charging cover circuit board 230, and is configured to be connected to an external power source to charge the charging cover battery 240. In one embodiment, as shown in FIGS. 11 and 12, the rechargeable sight assembly 100 or the red dot sight charging cover 200 thereof is charged. An external charging device 400, such as a charging cable, etc., may be connected to the charging terminal 280 exposed from the housing 270, so as to charge the charging cover battery 240 through the charging cover circuit board 230. If necessary, it is also possible to directly supply power to the rechargeable red dot sight 300 or to charge the red dot sight battery 370 of the rechargeable red dot sight 300. Such a design enables the red dot sight charging cover 200 to be directly charged while in use without being removed from the rechargeable red dot sight 300.

Figure 13:
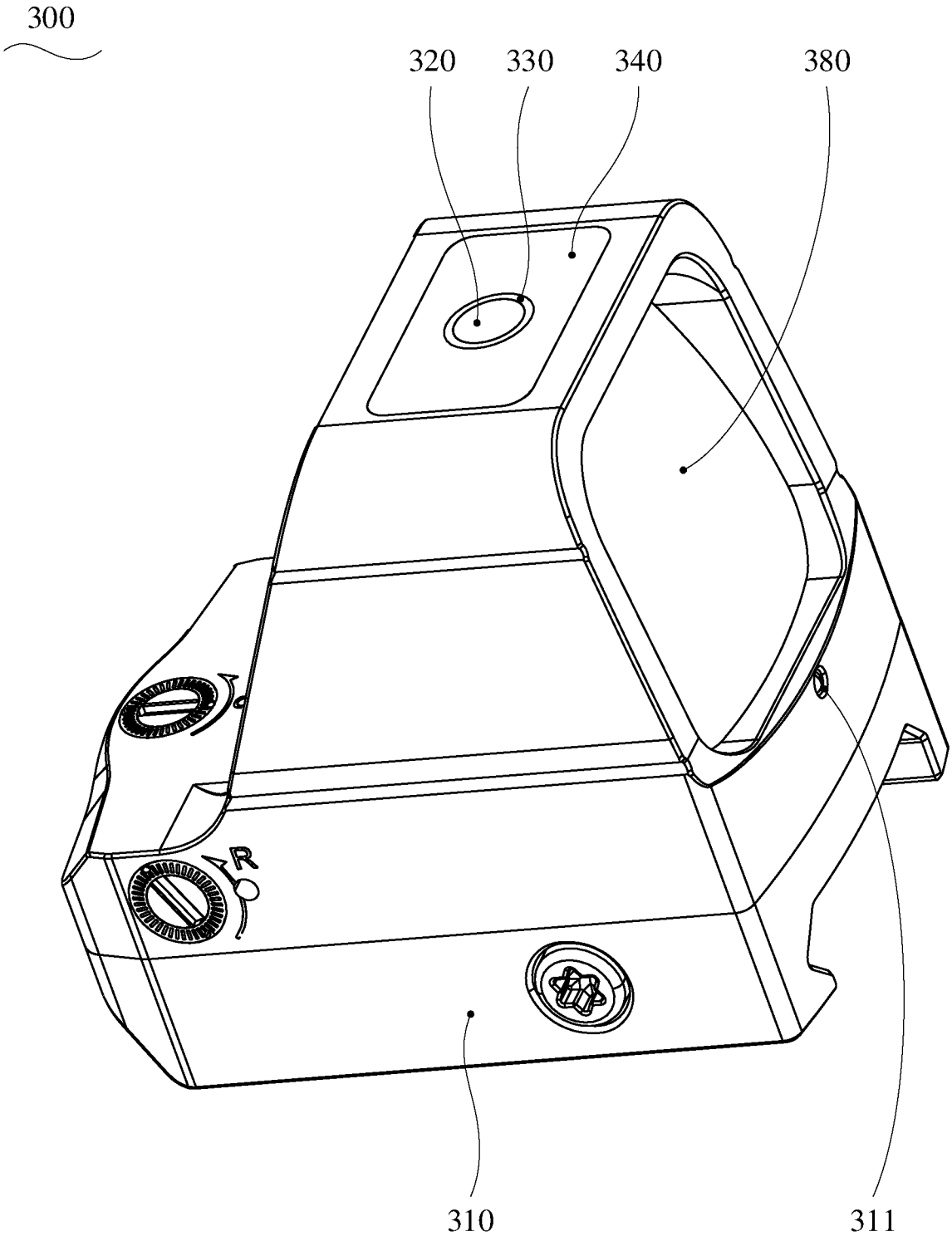
FIG. 13 is a perspective view of a rechargeable red dot sight shown in FIG. 2.
Figure 14:
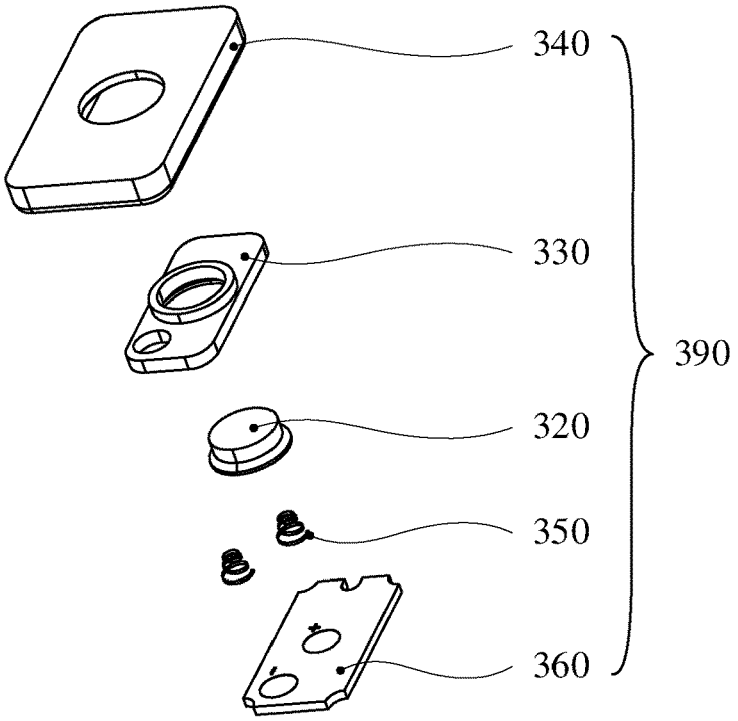
FIG. 14 is an exploded view of the embodiment shown in FIG. 13.
Figure 14:
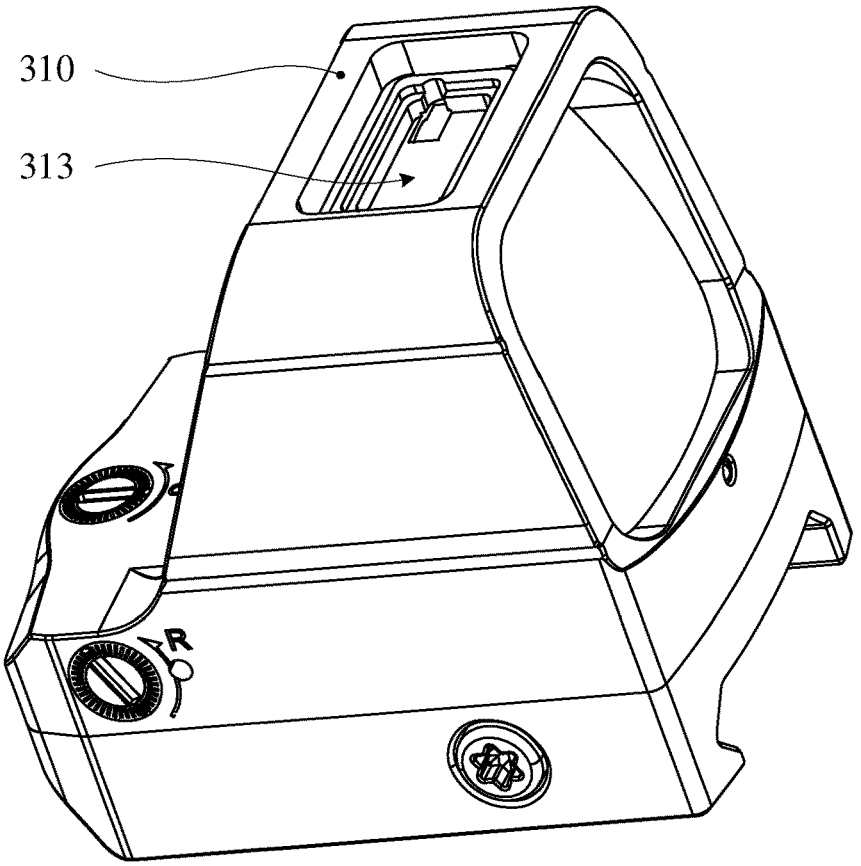

In one embodiment, a rechargeable red dot sight 300 is shown in FIGS. 13 and 14, which include a red dot sight body 310 and a conductive connecting member 390 provided on the red dot sight body 310. The conductive connecting member 390 is electrically connected to the red dot sight charging cover 200 or the charging cover conductive assembly 260 thereof. With such a structural design, when the rechargeable red dot sight 300 is in use, only the red dot sight charging cover 200 needs to be covered, the rechargeable red dot sight 300 can be powered or charged while being protected against dust. The rechargeable red dot sight 300 does not need to be disassembled and reassembled due to replacing or charging the battery. Therefore, it is unnecessary to recalibrate due to replacing or charging the battery, which greatly improving the convenience of the use of the rechargeable red dot sight 300.

Figure 15:
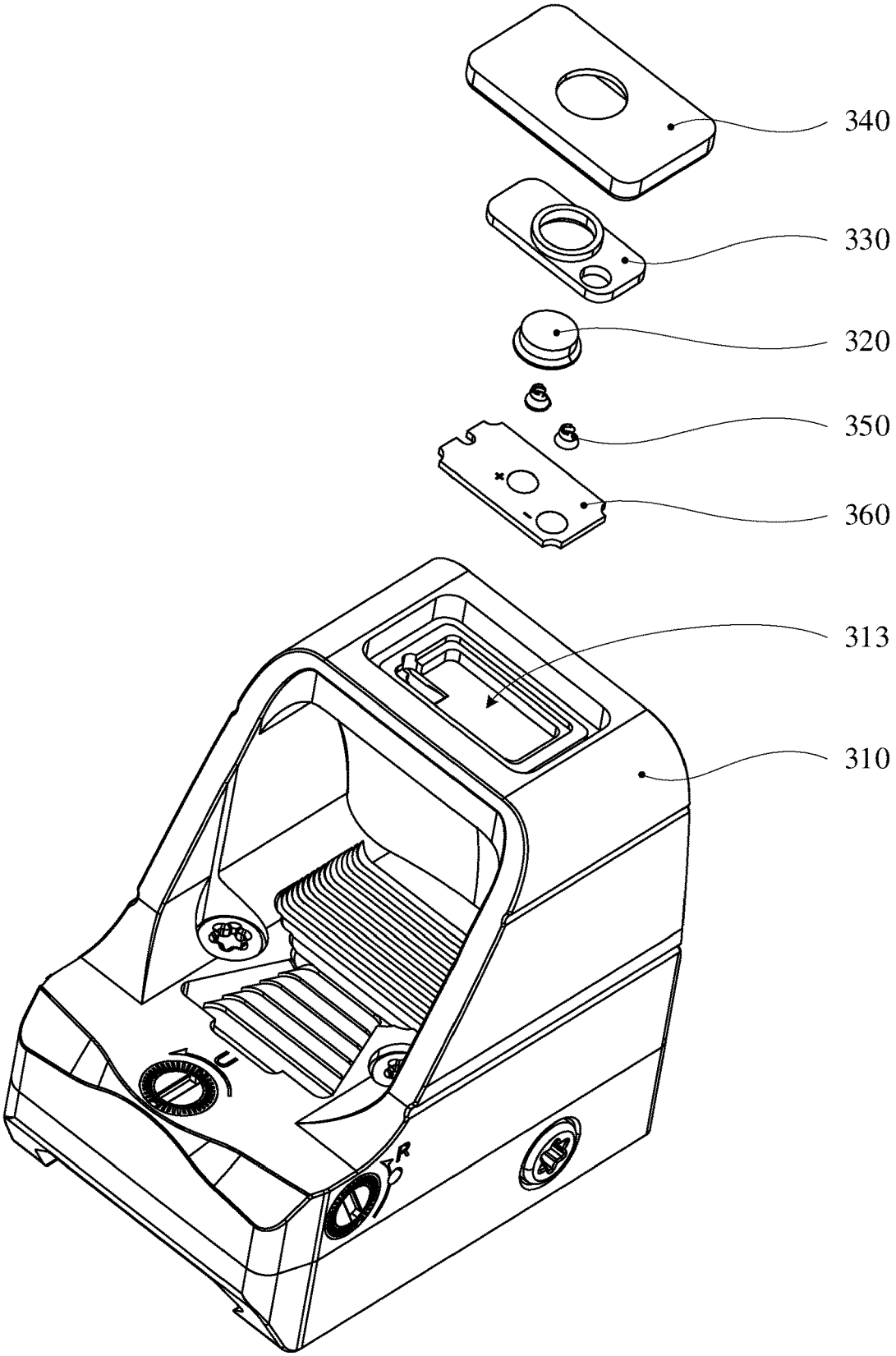
FIG. 15 is similar to FIG. 14, but viewed from another aspect.
Figure 16:
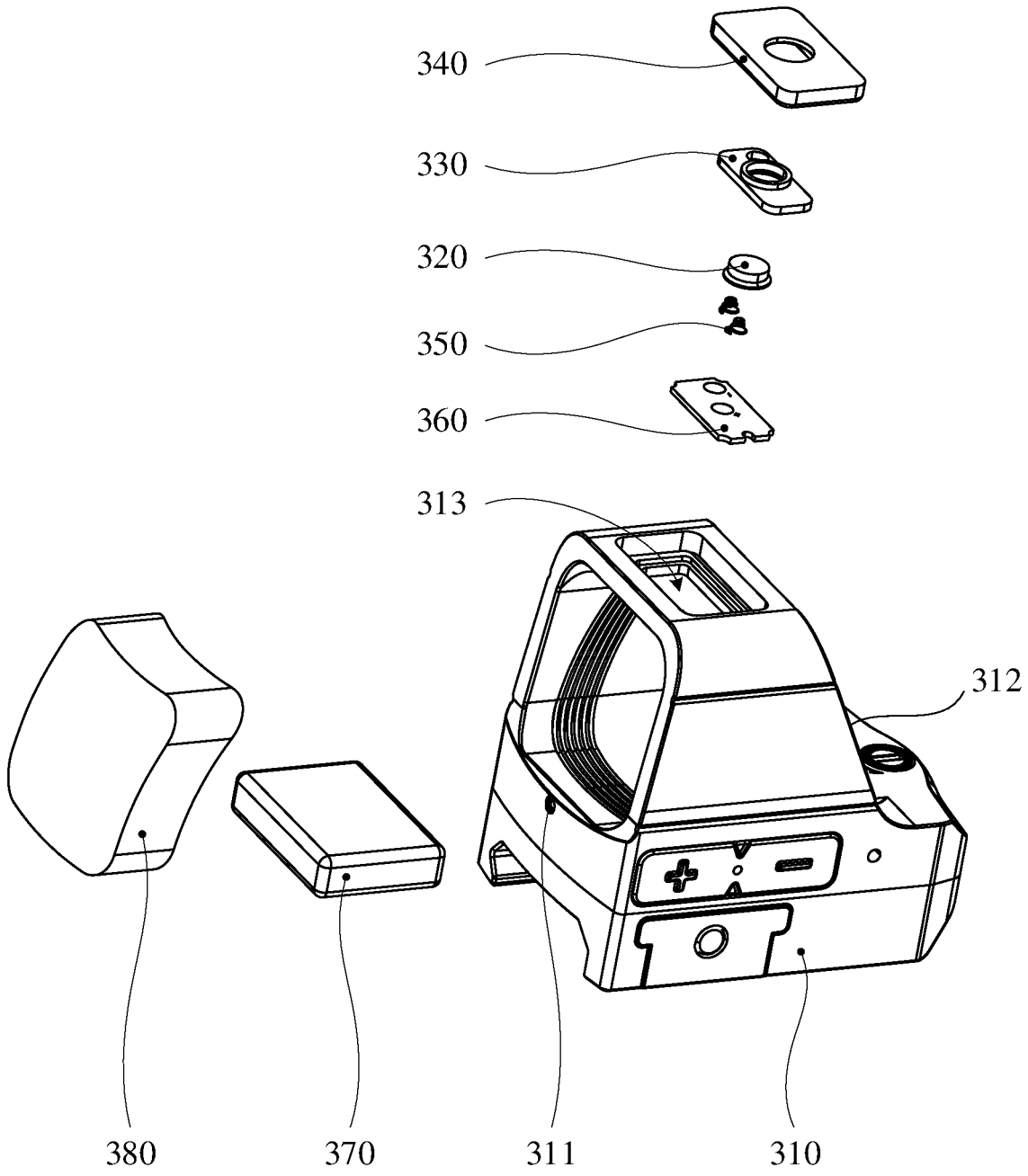
FIG. 16 is a further exploded view of FIG. 15.

In conjunction with FIGS. 15 and 16, in one embodiment, the rechargeable red dot sight 300 further includes a red dot sight battery 370 provided in the red dot sight body 310. The charging cover conductive assembly 260 electrically abuts against the conductive connecting member 390 and is electrically connected to the red dot sight battery 370 through the conductive connecting member 390. In other embodiments, the red dot sight battery 370 may be omitted, the rechargeable red dot sight 300 directly obtain electric energy from the red dot sight charging cover 200. Further, the red dot sight charging cover 200 has a vacant position to expose a lens 380 and a light source output end 312 of the rechargeable red dot sight 300. In an embodiment, the rechargeable red dot sight 300 further includes a light sensing and adjusting member 311, the light sensing and adjusting member 311 needs to be exposed to sense the intensity of the light of the external environment.

In order to stably realize the electrical connection between the red dot sight charging cover 200 and the rechargeable red dot sight 300. Further, in this embodiment, the conductive connecting member 390 includes a red dot sight positive conductive member 320, an insulating member 330, a red dot sight negative conductive member 340, two conductive springs 350, and a red dot sight circuit board 360. The red dot sight positive conductive member 320 is spaced apart from the red dot sight negative conductive member 340 through the insulating member 330, and the red dot sight positive conductive member 320 is electrically connected to the red dot sight circuit board 360 through one of the conductive springs 350. The red dot sight negative conductive member 340 is electrically connected to the red dot sight circuit board 360 through the other conductive spring 350. The red dot sight circuit board 360 is electrically connected to the red dot sight battery 370. The charging cover conductive assembly 260 electrically abuts against the red dot sight positive conductive member 320 and the red dot sight negative conductive member 340, respectively. Further, in one embodiment, the red dot sight positive conductive member 320 and the red dot sight negative conductive member 340 have contact surfaces with the same height. The charging cover conductive assembly 260 electrically abuts against the red dot sight positive conductive member 320 and the red dot sight negative conductive member 340 at the contact surface, respectively. Such a structural design, on the one hand, is beneficial for ensuring accurate abutment between the charging cover conductive assembly 260 and the red dot sight positive conductive member 320 and the red dot sight negative conductive member 340 when the housing 270 of the red dot sight charging cover 200 covers the rechargeable red dot sight 300. On the other hand, the design of the conductive spring 350 helps to provide a certain amount of buffer, so that the red dot sight charging cover 200 covers the rechargeable red dot sight 300 to achieve stable and effective electrical connection, and the conductive connecting member 390 is prevented from being damaged due to the red dot sight charging cover 200 being covering the rechargeable red dot sight 300, thereby ensuring the life of the product.

In one embodiment, as shown in FIGS. 13 and 14, the red dot sight body 310 is provided with a mounting groove 313. The conductive connecting member 390 is provided in the mounting groove 313, and an upper surface of the conductive connecting member 390 exposed from the mounting groove 313 is coplanar with an upper surface of the red dot sight body 310. That is, the upper surface of the red dot sight positive conductive member 320, the upper surface of the insulating member 330, and the upper surface of the red dot sight negative conductive member 340 are coplanar and are coplanar with the upper surface of the red dot sight body 310. Alternatively, the conductive connecting member 390 is recessed relative to the upper surface of the red dot sight body 310. That is, the conductive connecting member 390 is entirely located in the mounting groove 313, that is, the conductive connecting member 390 does not protrude from the mounting groove 313. Such a structural design facilitates the protection of the conductive connecting member 390 when assembling the rechargeable red dot sight 300.

In conjunction with FIGS. 13 and 16, in one embodiment, the rechargeable red dot sight 300 further includes a light sensing and adjusting member 311 provided on the red dot sight body 310. The light sensing and adjusting 311 is configured to sense light intensity of an external environment and brightness of a light source red dot of the red dot sight body 310 according to the light intensity. Since the rechargeable red dot sight 300 or the light source output end 312 of the red dot sight body 310 thereof is generally adjacent to the lens 380 of the rechargeable red dot sight 300, the light sensing and adjusting member 311 can be provided next to the light source output end 312 or the lens 380, or can be provided at other positions of the red dot sight body 310, so as to avoid affecting the light source output end 312 to output the light source red dot. Such a structural design facilitates ensuring the brightness of the red dot of the light source output by the light source output end 312, having sufficient recognizability compared with the light intensity of the external environment, and being easy to distinguish during use.

In conjunction with FIGS. 1 to 16, in one embodiment, the red dot sight charging cover 200 includes the covering body 210 and the housing 270. The covering body 210 and the housing 270 are fixedly connected, and a rubber ring is provided at the connection between the covering body 210 and the housing 270 as a sealing ring 220, which has a dust-proof effect on the red dot sight body 310.

In this embodiment, the charging cover battery 240 is mounted in the housing 270 and is configured to store power and supply power to the red dot sight body 310. The charging terminal 280 can be connected to the external charging device 400, such as a charging cable, for charging the charging cover battery 240.

The charging cover circuit board 230 is connected to the charging cover battery 240, the charging cover conductive assembly 260, the charging terminal 280, and the switch 293. The charging cover conductive assembly 260 includes a positive conductive member and a negative conductive member, which are separated by an insulating member. When the housing 270 covers the outside of the rechargeable red dot sight 300, the positive conductive member of the charging cover conductive assembly 260 is electrically connected to the red dot sight positive conductive member 320 of the rechargeable red dot sight 300. The negative conductive member of the charging cover conductive assembly 260 is electrically connected to the red dot sight negative conductive member 340 of the rechargeable red dot sight 300.

The magnet 250 is provided adjacent to the charging cover conductive assembly 260. The button 291, the button spring 292, and the switch 293 are connected to control the power supply function of the red dot sight charging cover 200.

The red dot sight battery 370 is provided in the red dot sight body 310, and the red dot sight battery 370 is connected to the red dot sight circuit board 360. Meanwhile, the red dot sight circuit board 360 is further connected to the conductive spring 350. At least two conductive springs 350 are provided. One of the conductive springs 350 is electrically connected to the red dot sight positive conductive member 320, and the other conductive spring 350 is electrically connected to the red dot sight negative conductive member 340.

The red dot sight positive conductive member 320 and the red dot sight negative conductive member 340 are spaced apart by an insulating member 330. The red dot sight negative conductive member 340 on the surface of the rechargeable red dot sight 300 is made of a magnetic metal material and can be attracted by the magnet 250, so that the red dot sight charging cover 200 and the rechargeable red dot sight 300 are firmly connected.

When the red dot sight charging cover 200 covers the rechargeable red dot sight 300, the positive conductive member of the charging cover conductive assembly 260 is in contact with the red dot sight positive conductive member 320, and the negative conductive member of the charging cover conductive assembly 260 is in contact with the red dot sight negative conductive member 340. After the switch 293 is turned on, the red dot sight charging cover 200 can supply power to the rechargeable red dot sight 300. In this way, the user only needs to cover the rechargeable red dot sight 300 with the red dot sight charging cover 200, so that the rechargeable red dot sight 300 can be charged while being protected against dust, which is simple and convenient.

Meanwhile, the housing of the red dot sight charging cover 200 and the rechargeable red dot sight 300 are provided with corresponding protrusion and groove, respectively, so that the red dot sight charging cover 200 and the rechargeable red dot sight 300 are connected more firmly.

In one embodiment, the covering body 210 is a display screen that can display the current power level of the red dot sight charging cover 200 and/or the rechargeable red dot sight 300. Further, the display screen is configured such that when the red dot sight charging cover 200 is disconnected from the rechargeable red dot sight 300, that is, when the two are not in contact, the display screen shows the power level of the red dot sight 200. When the red dot sight charging cover 200 is in contact with the rechargeable red dot sight 300, that is, when the housing 270 of the red dot sight charging cover 200 covers the rechargeable red dot sight 300, the display screen shows the power level of the rechargeable red dot sight 300. In such a design, the power information of the red dot sight charging cover 200 and the rechargeable red dot sight 300 can be easily obtained without complicated operation, and the application is very convenient.

In one embodiment, the light sensing and adjusting member 311 is provided in the red dot sight body 310 to sense the light intensity of the environment in which the red dot sight body 310 is located. The red dot sight body 310 adjusts the brightness of the red dot of the light source according to the light intensity of the surrounding environment, so as to facilitate the user to aim.

The rechargeable sight assembly 100, the red dot sight charging cover 200, and the rechargeable red dot sight 300 will continue to be described in conjunction with specific product examples. In one embodiment, the rechargeable red dot sight 300 includes the red dot sight body 310. The top portion of the red dot sight body 310 is provided with the mounting groove 313. The conductive connecting member 390 is fixedly mounted in the mounting groove 313. Sides of the red dot sight body 310 are symmetrically provided with snap-in grooves.

In one embodiment, the conductive connecting member 390 includes the red dot sight circuit board 360. The red dot sight circuit board 360 is fixedly mounted in the mounting groove 313 through a contact cover plate. The red dot sight circuit board 360 has two connecting poles, which serve as the red dot sight positive conductive member 320 and the red dot sight negative conductive member 340, respectively. The two connecting poles are respectively connected to the charging cover conductive assembly 260 through the contact cover plate, and the red dot sight circuit board 360 is connected to the battery in the rechargeable red dot sight 300 through a wire.

In one embodiment, the housing 270 of the red dot sight charging cover 200 includes a lower housing and an upper housing. The lower housing is provided with a snap-fit groove extending through a side thereof. A snap-fit device is snapped into the snap-fit groove. The lower housing is fixedly mounted on a top outer side of the rechargeable red dot sight 300 or the red dot sight body 310 thereof by the snap-fit device. The lower housing wraps around the rechargeable red dot sight 300 and forms a relative seal with the rechargeable red dot sight 300, which can protect the lens 380 of the rechargeable red dot sight 300 and can be prevent external dust, etc., from contaminating the lens 380 of the rechargeable red dot sight 300.

In one embodiment, the snap-fit device includes a clip that is rotatably mounted in the snap-fit groove by a rotating shaft. A limiting column is provided at a top portion of an inner side of the snap-fit groove, and a pressing ring is fixedly mounted on the limiting column. A top portion of the clip is provided with a pressing plate, an inner side of the pressing plate abuts against an end surface of the pressing ring, an inner side of a bottom portion of the clip is provided with a snap-fit protrusion, and the snap-fit protrusion is adapted to the snap-fit groove. In one embodiment, the limiting column and the snap-fit groove are integrally formed. The pressing ring is snapped to the limiting column. The clip can rotate around the rotating shaft. For example, when in use, the rechargeable red dot sight 300 is inserted from a lower portion of the lower housing, and the pressure plate is held by fingers. At this time, the pressing plate rotates inward around the rotating shaft, the clip rotates outward around the rotating shaft, and then lower housing is pressed downward. In this case, the snap-fit protrusion slides downward along a side surface of the red dot sight body 310. The pressing plate is released when the snap-fit protrusion slides to the snap-fit groove. In this state, the pressing ring exerts an outward elastic force on the pressing plate without any external force. Under the elastic force of the pressing ring, the pressing plate rotates outward around the rotating shaft. At this time, the clip rotates inward around the rotating shaft. After the snap-fit protrusion is snapped into the snap-fit groove, the elastic force applied to the pressing plate will cause the snap-fit protrusion to be pressed into the snap-fit groove by the clip, so as to achieve relative fixation between the lower housing and the rechargeable red dot sight 300. When it is necessary to remove the lower housing to use the rechargeable red dot sight 300, for example, the pressing plates on both sides can be hold with fingers at the same time. When the pressure exerted by the fingers is greater than the elastic force of the pressing ring, the pressing plate rotates inwards around the rotating shaft, and the clip rotates outwards around the rotating shaft. At this time, the snap-fit protrusion is separated from the snap-fit groove, and then the lower housing is lifted upwards, so that the lower housing can be separated from the rechargeable red dot sight 300.

In one embodiment, the upper housing is snapped to the lower housing. For example, the upper housing can be provided with a button port, a display port, and a charging port. In one embodiment, the charging cover battery 240 is provided between the upper housing and the lower housing, or the upper housing and the lower housing together form the inner cavity 271 accommodating the charging cover battery 240. The charging cover battery 240 is connected to the conductive connecting member 390 through the charging cover conductive assembly 260, so as to charge the rechargeable red dot sight 300. In one embodiment, the charging cover battery 240 is further connected to a display screen as a power display device configured to display the power level of the rechargeable red dot sight 300 in real time.

In one embodiment, the internal cavity 271 can be divided into a battery cavity and a contact cavity. The charging cover battery 240 is fixedly mounted in the battery cavity, and the connecting poles of the red dot sight circuit board 360 is located directly below the contact cavity. The charging cover conductive assembly 260 is connected to the connecting poles of the red dot sight circuit board 360 through the contact cavity.

In one embodiment, the control switch 290 is provided on the upper housing of the red dot sight charging cover 200. The button 291 of the control switch 290 is fixedly mounted on the top portion of the upper housing. The switch 293 extends through the upper housing and is connected to the bottom portion of the button 291. The switch 293 is connected to the charging cover battery 240 through a wire, and the charging cover battery 240 is connected to a display screen through a wire. For example, the button 291 is fixedly mounted at the button port, and the switch 293 is snapped directly above the contact cavity. A downward force is applied to the button 291, and the button 291 presses the switch 293 through the button spring 292 to generate a signal, at which time the display screen will display the power level. A display window of the display screen is directly opposite to the display port, so that the contents displayed on the display screen can be observed through the display port.

In one embodiment, the charging cover conductive assembly 260 includes two connecting poles as the positive conductive member and the negative conductive member, and the two connecting poles are spaced apart by an insulating member. The connecting poles are fixedly mounted at the bottom portion of the switch 293 and extend through the lower housing and abut against top surfaces of the contact poles of the red dot sight circuit board 360. The connecting pole is connected to the charging cover battery 240 through a wire. A waterproof sealing member is sleeved between the bottom portion of the connecting pole and the lower housing. For example, the connecting poles extend through the contact cavity and abut against the top surface of the contact poles of the red dot sight circuit board 360. The waterproof sealing member wraps the connecting poles and is in contact with the inner wall of the contact cavity. The waterproof sealing member can prevent external moisture from entering the lower housing from the contact cavity. The electrical energy stored in the charging cover battery 240 may be transferred to the connecting poles via a wire, and then transferred to the battery in the rechargeable red dot sight 300 via the red dot sight board 360. In one embodiment, the charging cover conductive assembly 260 further includes the charging terminal 280. The bottom surface of the charging terminal 280 is connected to the charging cover battery 240 through a wire, and the top portion of the charging terminal 280 extends through the left side of the upper housing and is coplanar with the top surface of the left side of the upper housing. When the power level of the charging cover battery 240 is low, the charging cover battery 240 can be charged through the charging terminal 280.

It should be noted that the rechargeable red dot sight cover, the rechargeable red dot sight, and the rechargeable sight assembly formed by combining the technical features of the above-mentioned embodiments may be provided in other embodiments.

Although the respective embodiments have been described one by one, it should be appreciated that the respective embodiments will not be isolated. Those skilled in the art can apparently appreciate upon reading the disclosure of this application that the respective technical features involved in the respective embodiments can be combined arbitrarily between the respective embodiments as long as they have no collision with each other. Of course, the respective technical features mentioned in the same embodiment can also be combined arbitrarily as long as they have no collision with each other.

The foregoing descriptions are merely specific embodiments of the present disclosure, but are not intended to limit the protection scope of the present disclosure. Any variation or replacement readily figured out by a person skilled in the art within the technical scope disclosed in the present disclosure should all fall within the protection scope of the present disclosure. Therefore, the protection scope of the present disclosure should be subject to the protection scope of the appended claims.

What is claimed is:

1. A red dot sight charging cover, comprising:

a housing;

a charging cover circuit board;

a charging cover battery; and a charging cover conductive assembly that are provided in the housing;

wherein a shape of the housing is adapted to a rechargeable red dot sight, and the housing detachably covers the rechargeable red dot sight;

when the housing covers the rechargeable red dot sight, the charging cover conductive assembly is electrically connected to the rechargeable red dot sight;

wherein the charging cover circuit board is electrically connected to the charging cover battery and the charging cover conductive assembly, respectively, and the charging cover circuit board is configured to control the charging cover battery to supply power to the rechargeable red dot sight through the charging cover conductive assembly.

2. The red dot sight charging cover according to claim 1, wherein the housing covers the rechargeable red dot sight from top to bottom.

3. The red dot sight charging cover according to claim 1, wherein the housing is provided with an inner cavity, and the charging cover circuit board, the charging cover battery, and the charging cover conductive assembly are accommodated in the inner cavity.

4. The red dot sight charging cover according to claim 1, further comprising a covering body detachably covered on the housing to close the housing from the top the housing, wherein when the covering body is removed, the charging cover circuit board is completely exposed to remove the charging cover circuit board.

5. The red dot sight charging cover according to claim 4, further comprising a sealing ring, wherein the covering body is sealingly covered on the housing through the sealing ring.

6. The red dot sight charging cover according to claim 1, further comprising a magnet provided in the housing and adjacent to the charging cover conductive assembly, wherein the magnet is configured to magnetically attract the rechargeable red dot sight or a red dot sight negative conductive member of the rechargeable red dot sight, so that the charging cover conductive assembly is positioned and is electrically connected to the rechargeable red dot sight.

7. The red dot sight charging cover according to claim 1, further comprising a control switch provided in the housing and exposed from the housing, wherein the control switch is electrically connected to the charging cover circuit board and is configured to control the charging cover battery to be electrically connected to or disconnected form the charging cover conductive assembly.

8. The red dot sight charging cover according to claim 7, wherein the control switch comprises a button, a button spring, and a switch, the button is at least partially exposed from the housing, and the button spring elastically abuts between the button and the switch, and the switch is electrically connected to the charging cover circuit board.

9. The red dot sight charging cover according to claim 1, further comprising a charging terminal provided in the housing and exposed from the housing, wherein the charging terminal is electrically connected to the charging cover circuit board and is configured to be connected to an external power source to charge the charging cover battery.

10. The red dot sight charging cover according to claim 1, further comprising a display screen provided in the housing and electrically connected to the charging cover circuit board.

11. The red dot sight charging cover according to claim 1, wherein one of the housing and the rechargeable red dot sight is provided with a convex portion or a groove, the other one of the housing and the rechargeable red dot sight is provided with a groove or convex portion, when the housing covers the rechargeable red dot sight, the housing is engaged with the rechargeable red dot sight through the corresponding convex portion and the groove.

12. The red dot sight charging cover according to claim 1, wherein the charging cover circuit board is configured to control the charging cover battery to charge a red dot sight battery of the chargeable red dot sight through the charging cover conductive assembly.

13. A rechargeable red dot sight, comprising a red dot sight body and a conductive connecting member, wherein the conductive connecting member is provided on the red dot sight body, and the conductive connecting member is electrically connected to a red dot sight charging cover or a charging cover conductive assembly of a red dot sight charging cover.

14. The rechargeable red dot sight according to claim 13, further comprising a light sensing and adjusting member provided on the red dot sight body, wherein the light sensing and adjusting member is configured to sense light intensity of an external environment and adjust brightness of a light source red dot of the red dot sight body according to the light intensity.

15. The rechargeable red dot sight according to claim 13, further comprising a red dot sight battery provided in the red dot sight body, wherein the charging cover conductive assembly electrically abuts against the conductive connecting member and is electrically connected to the red dot sight battery through the conductive connecting member.

16. The rechargeable red dot sight according to claim 15, wherein the conductive connecting member comprises a red dot sight positive conductive member, an insulating member, a red dot sight negative conductive member, two conductive springs, and a red dot sight circuit board, the red dot sight positive conductive member is spaced apart from the red dot sight negative conductive member through the insulating member, the red dot sight positive conductive member is electrically connected to the red dot sight circuit board through one of the conductive springs, the red dot sight negative conductive member is electrically connected to the red dot sight circuit board through the other conductive spring, the red dot sight circuit board is electrically connected to the red dot sight battery, and the charging cover conductive assembly electrically abuts against the red dot sight positive conductive member and the red dot sight negative conductive member, respectively.

17. The rechargeable red dot sight according to claim 16, wherein the red dot sight positive conductive member and the red dot sight negative conductive member have contact surfaces with the same height, and the charging cover conductive assembly electrically abuts against the red dot sight positive conductive member and the red dot sight negative conductive member at the contact surface, respectively.

18. A rechargeable sight assembly, comprising: a rechargeable red dot sight and the red dot sight charging cover according to claim 1, wherein the rechargeable red dot sight comprises a red dot sight body and a conductive connecting member, the conductive connecting member is provided on the red dot sight body, the conductive connecting member is electrically connected to a red dot sight charging cover or a charging cover conductive assembly of a red dot sight charging cover, the housing of the red dot sight charging cover detachably covers the rechargeable red dot sight, and the charging cover conductive assembly of the red dot sight charging cover is electrically connected to the rechargeable red dot sight or a red dot sight battery of a rechargeable red dot sight.

* * * * *